US007165369B2

(12) United States Patent
Jandl

(10) Patent No.: US 7,165,369 B2
(45) Date of Patent: Jan. 23, 2007

(54) BUILDING

(76) Inventor: Adolf Jandl, Hartelsberg 26, Eitweg (AT) A-9421

( * ) Notice: Subject to any disclaimer, the term of this patent is extended or adjusted under 35 U.S.C. 154(b) by 289 days.

(21) Appl. No.: 10/380,205

(22) PCT Filed: Sep. 10, 2001

(86) PCT No.: PCT/AT01/00284

§ 371 (c)(1),
(2), (4) Date: Mar. 13, 2003

(87) PCT Pub. No.: WO02/22975

PCT Pub. Date: Mar. 21, 2002

(65) Prior Publication Data

US 2003/0167714 A1 Sep. 11, 2003

(30) Foreign Application Priority Data

Sep. 14, 2000 (AT) ..... A 1561/2000

(51) Int. Cl.
*E04C 2/38* (2006.01)

(52) U.S. Cl. ..... 52/475.1; 52/145; 52/302.3; 52/479

(58) Field of Classification Search ..... 52/220.2, 52/220.3, 220.7, 95, 302.1, 144, 408, 36.1, 52/90, 101, 199, 1, 302.3, 302.4, 474, 475.1, 52/479, 145
See application file for complete search history.

(56) References Cited

U.S. PATENT DOCUMENTS 1,086,031 A * 2/1914 Davis ..... 52/216
1,928,034 A * 9/1933 Schulstadt ..... 428/49
2,339,220 A * 1/1944 Chase ..... 52/282.4
3,204,379 A * 9/1965 Osborn ..... 52/302.6
4,012,882 A * 3/1977 Juriss et al. ..... 52/793.11
4,147,004 A * 4/1979 Day et al. ..... 52/309.9
4,165,591 A 8/1979 Fitzgibbon
4,655,024 A 4/1987 Grace et al.
4,658,552 A * 4/1987 Mulford ..... 52/94
4,817,355 A * 4/1989 Tilsley et al. ..... 52/407.4
4,852,314 A * 8/1989 Moore, Jr. ..... 52/199
4,856,238 A * 8/1989 Kesting ..... 52/220.2
4,894,964 A * 1/1990 Thrift et al. ..... 52/93.1
5,588,269 A * 12/1996 Wagner ..... 52/270
6,023,907 A * 2/2000 Pervan ..... 52/748.1

(Continued)

FOREIGN PATENT DOCUMENTS

DE 197 02 860 8/1998

(Continued)

*Primary Examiner*—Jeanette E. Chapman
*Assistant Examiner*—Yvonne M. Horton
(74) *Attorney, Agent, or Firm*—Young & Thompson

(57) ABSTRACT

A building, comprises sheets of wooden material with the external walls (10), internal walls (1), floor and/or roof boards (20) each made of wooden sheets and of a double- or multi-skinned form, thus comprising at least one inner sheet (2, 12, 22) and at least one outer sheet (3, 13, 23) which are separated by spacer elements (4, 14, 24) and connected to each other by the same. Cavities (5, 15, 25) are provided between the sheets (2, 3; 12, 13; 22; 23). The sheets forming the inner walls (1), the outer walls (10), the floor or roof boards (20) are, at least in one direction, in one piece throughout.

4 Claims, 21 Drawing Sheets

U.S. PATENT DOCUMENTS

| | | | | |
|---|---|---|---|---|
| 6,279,284 | B1 * | 8/2001 | Moras | 52/408 |
| 6,668,504 | B1 * | 12/2003 | Hughart | 52/481.1 |
| 2003/0126806 | A1 * | 7/2003 | Ellis | 52/95 |

FOREIGN PATENT DOCUMENTS

| | | |
|---|---|---|
| EP | 0 670 397 | 9/1995 |
| FR | 2 586 729 | 3/1987 |
| GB | 1 360 876 | 7/1974 |
| WO | WO 00 29180 | 5/2000 |

* cited by examiner

BUILDING

The invention relates to a building of derived timber products, especially derived timber product panels with the features of the introductory part of independent claim 1.

GB 2 287 047 A shows a building of the initially mentioned type made of sheets of derived timber products, for example sheets of particle sheet, the outside walls, the inside walls, and the ceiling sheets being made with two shells and there being cavities between the individual surfaces of the sheets. In GB 2 287 047 A the multiple-shell sheets comprising the building are joined only on site, therefore when the building is being erected, out of individual sheets and spacers.

FR 2 194 145 A discloses routing the plumbing and power through cavities provided in the sheets for the building.

U.S. Pat. No. 5,588,269 discloses a building in which the outside walls, the floor slabs and the roof panels each consist of derived timber product panels which have at least one inside panel and at least one outside panel. The inside panel and the outside panel of the panels of the building are spaced apart from one another and are connected to one another by spacer elements, there being cavities between the inside and outside panels. The panels which form the outside walls, the floor slabs and the roof elements are made continuous in one piece at least in one direction. Finally, the panels are prefabricated in the dimensions required at the time and with the necessary edge execution.

The object of the invention is to make available a building, especially a residence which can be freely planned and which consists exclusively or at least for the most part of derived timber product sheets, especially sheets of particle board.

This object is achieved with a building which has the features of claim 1.

Preferred and advantageous embodiments of the building as claimed in the invention are the subject matter of the dependent claims.

Since the building as claimed in the invention consists of sheets of particle board, it can be freely planned, especially when according to one proposal of the invention the derived timber product sheets are made continuously in one piece in at least one direction of the outside walls, the inside walls, the ceilings and/or the roof.

The concept as claimed in the invention also makes it possible to plan the building using the Internet by inputting wishes with respect to configuration and size of the house via a corresponding Internet page by an interested party. In the case of contracting, the data computed in this way can be used directly to activate the plants of the manufacturer of the derived timber product sheets.

The sheets as claimed in the invention which comprise the building are made with at least two shells, between the shells formed by the sheets there being cavities defined by spacers, such as spacer strips or spacer blocks, in which for example the plumbing and electricity can be accommodated. The cavities in the sheets can also be used for hot air heating or for cooling of the building. Furthermore, the cavity in the sheets comprising the house can be filled in order to adapt the insulation properties, especially the noise control properties of the sheets, to the respective requirement. The cavities in the sheets comprising the building as claimed in the invention can be filled with any materials. The material which is optionally contained in the sheets (or with which they are filled only after the sheets have been assembled into a partially or entirely completed building) can also be chosen such that (for example, concrete, lightweight concrete, etc.) a building results which is made at least partially as a solid building.

Advantageously, in the building as claimed in the invention the inner surfaces of the sheets facing the bounded space are finished to such an extent that they can be immediately painted or papered. This becomes possible especially by the use of sheets of particle board which have extremely low swelling and shrinking behavior so that they can be worked very precisely. Therefore interior-finished, self-supporting walls with integrated cavities, optionally with internals already contained therein, such as plumbing, electrical and ventilation, can be prefabricated and made available.

In the building as claimed in the invention it is possible to connect the cavities in the sheets which form the walls (inside walls and outside walls) to the cavities in the sheets which form the ceilings and/or roof so that overall heating or cooling of the building and thus an especially uniform room temperature are possible. This also makes it possible to air condition the building without special cost by connecting the cavities to an air conditioning plant. For example an air-heat pump can be used to heat the building.

Insulation and exterior rendering can be applied to the outside surfaces of the outside walls. The roof elements can be provided with an ordinary covering.

Sheets of particle board are especially preferred within the framework of the invention.

Sheets of particle board in the form of multilayer sheets which have been fabricated from slender, aligned wood shavings with a predetermined shape and thickness and a binder are preferred. The wood shavings in the outside layers are aligned parallel to the sheet length or width; the wood shavings in the middle layer can be randomly arranged or are in general at a right angle to the wood shavings of the outside layer. The flat shavings used to produce these sheets generally have a length of roughly 60 mm, a width of 35 mm and a thickness of 0.6 mm. By means of the cutting process and as a result of further processing (drying, screening, transport, cementing, scattering) the shavings are damaged (shaving rupture, distortions, curling, kinking of the shavings); this causes a relatively large fine portion (small, indefinable shaving geometry) of the cut material. The shavings of the cover layers generally have, since part of the fine material can be screened out again, a smaller fine portion than the shavings of the middle layers.

For the invention, derived timber product sheets can also be used which consist of long, slender, aligned wood shavings with a predetermined shape and thickness which are joined by a binder into a single-layer sheet. The orientation of the wood shavings is essentially uniform over the entire thickness of the sheets. There is no transversely-scattered middle layer.

The spacers (strips or blocks) can consist of derived timber product and can be for example appropriately dimensioned particle boards. This makes it possible to manufacture the derived timber product sheets in the sheet manufacturing plant in the size required at the time and with the required edge formations. These sheets of particle board are rather stable so that they also satisfy the static requirements of the building without additional measures being necessary.

For inside walls, preferably derived timber product sheets are used which are made of two particle boards with strips or blocks which define the cavities between the sheets, which space the sheets apart and which are located in between, the sheets being connected to spacers, especially glued.

The outside walls are derived timber product sheets which for example on their (inner) side facing the bounded space have an individual sheet, for example particle board, and on their outside two sheets directly joined to one another, for example, glued, preferably particle boards, the individual sheet and the double sheet being connected to one another via spacers (blocks or strips).

For the ceiling and the roof, derived timber product sheets can be used in which on the inside and outside there is one sheet at a time, preferably a sheet of particle board, which are joined, for example glued, to one another by thicker spacers or multilayer spacers in the form of blocks or strips at a distance.

For multi-story buildings the sheets which form the inside walls and/or the outside walls can be joined to one another with a horizontal joint so that inside walls or outside walls which pass in the horizontal direction are formed.

The ceiling elements and/or roof elements likewise pass in at least one direction and are coupled to one another for example via hook-like edge formations.

The described execution of the building as claimed in the invention allows it to be freely planned, the individual parts of the building (inside walls, outside walls, ceilings and roof) also being fabricated to the appropriate size in the plant in which the sheets (for example, sheets of particle board) are produced and then are transported directly to the construction site. Thus, cutting to size or trimming are no longer necessary at the construction site, but it is enough to assemble the building from the prefabricated inside and outside walls and the ceiling and roof parts, especially when the individual parts of the building as claimed in the invention are worked where necessary on their edges, for example milled to shape.

If sufficient release of moisture which has been absorbed in the sheets is not ensured, because for example there are vapor barriers, it is possible to discharge this moisture through the cavities by ventilating them sufficiently, for example by the intended heating of the houses, through them.

Other details and features of the building as claimed in the invention are explained in the following description of preferred embodiments with reference to the attached drawings.

Figure 3:
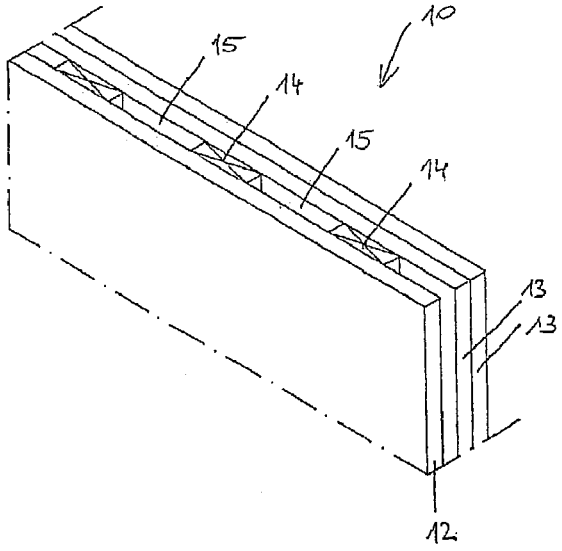
Figure 4:
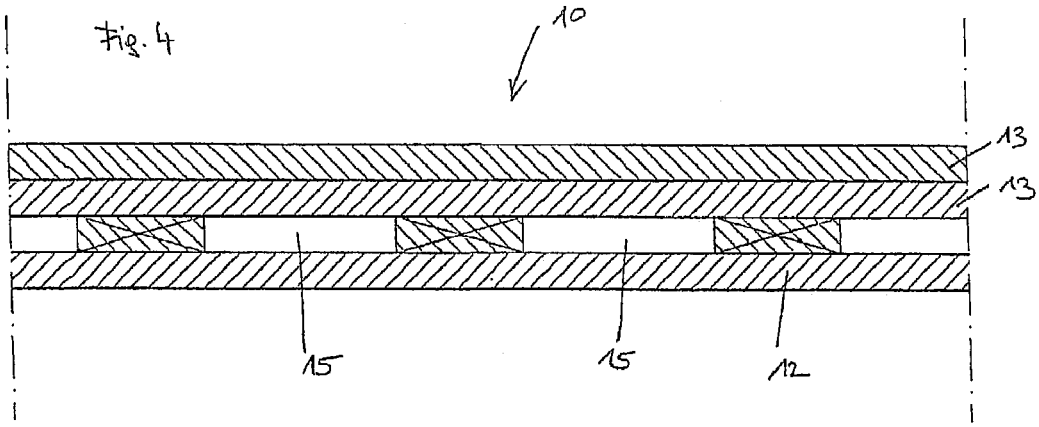
Figure 5:
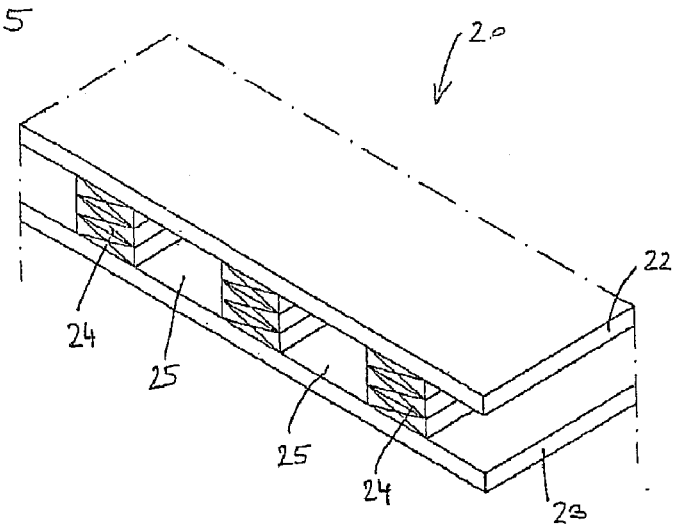
Figure 6:
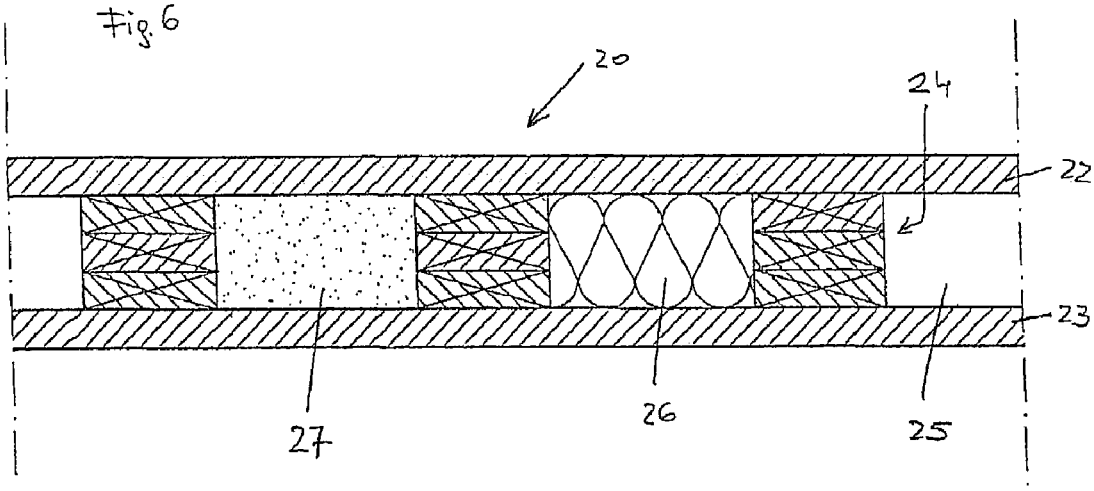
Figure 7:
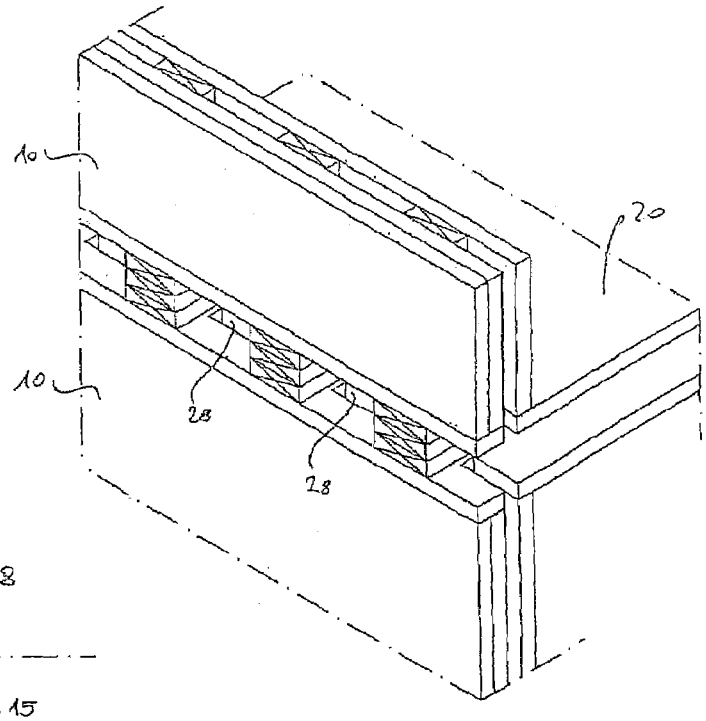
Figure 8:
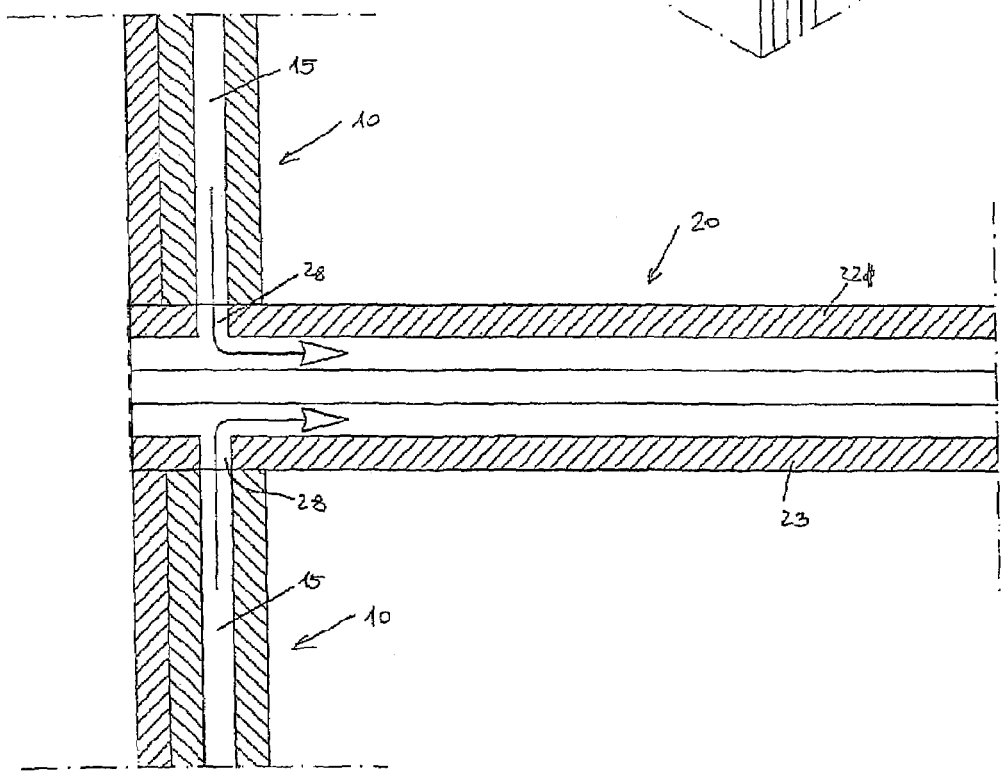
Figure 9:
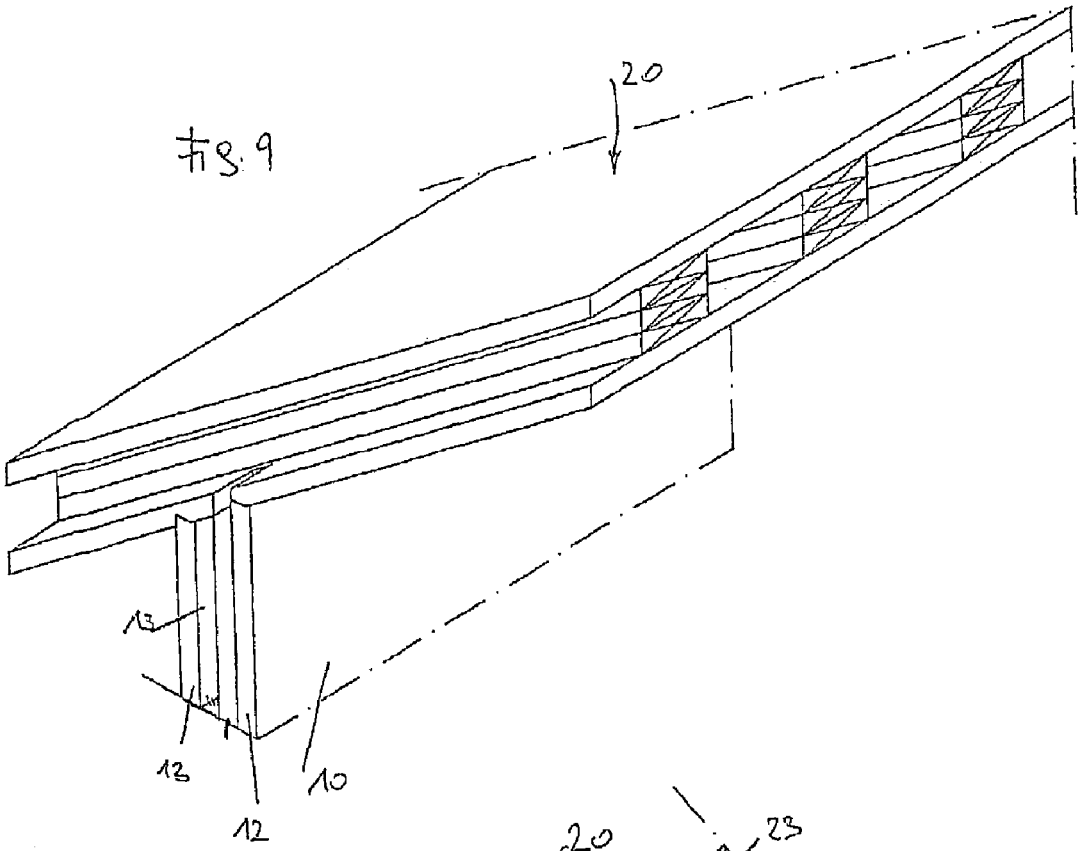
Figure 10:
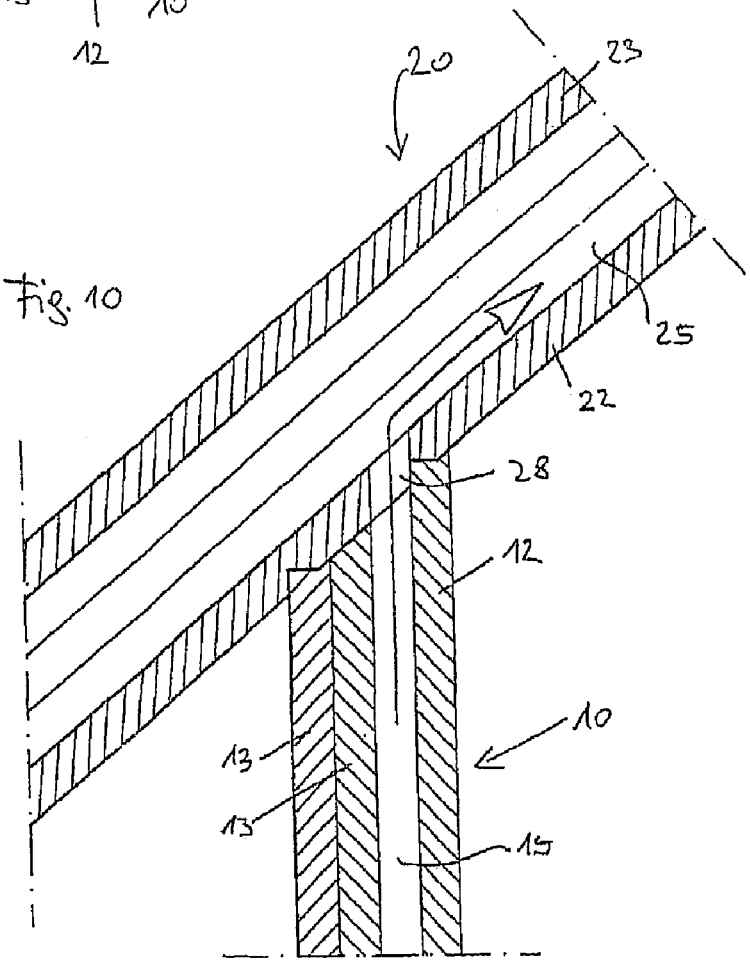
Figure 11:
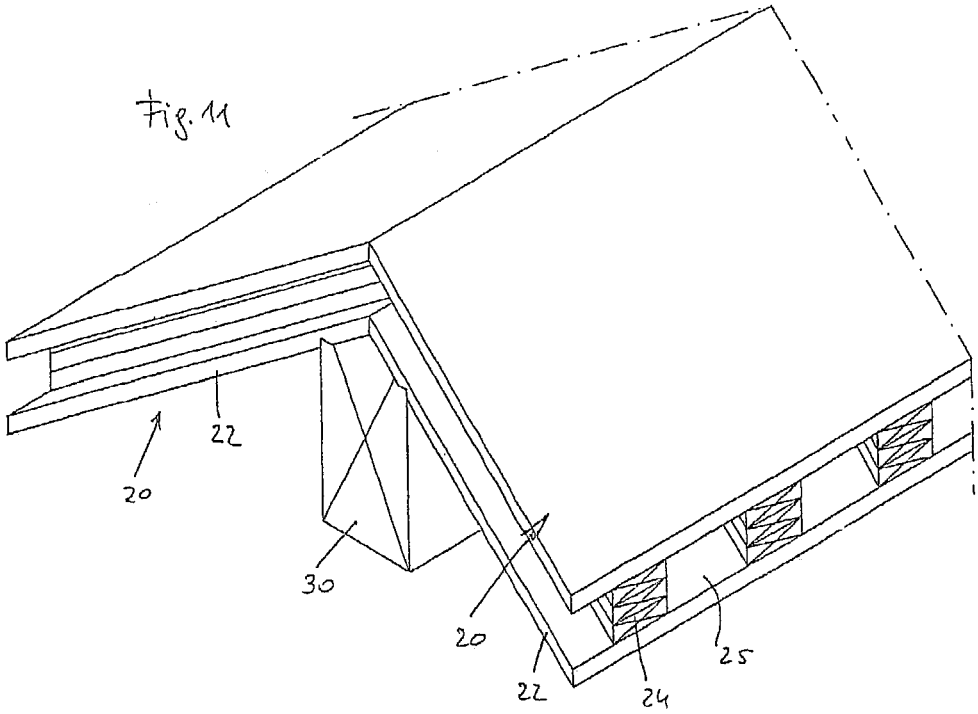
Figure 12:
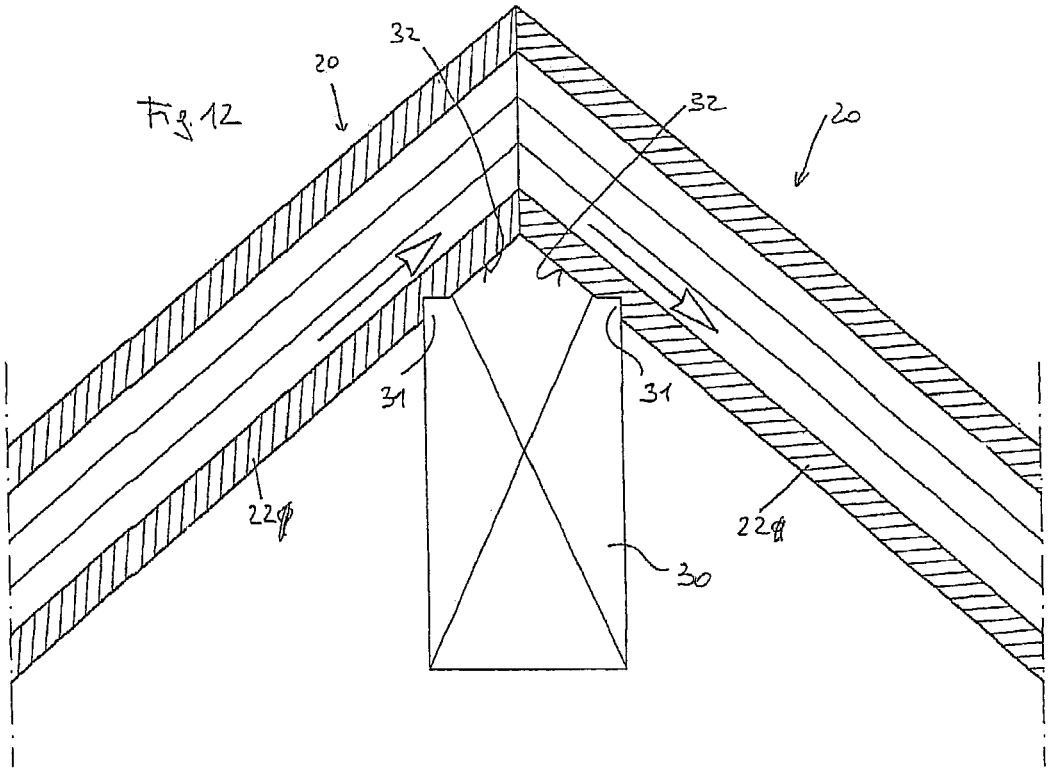
Figure 13:
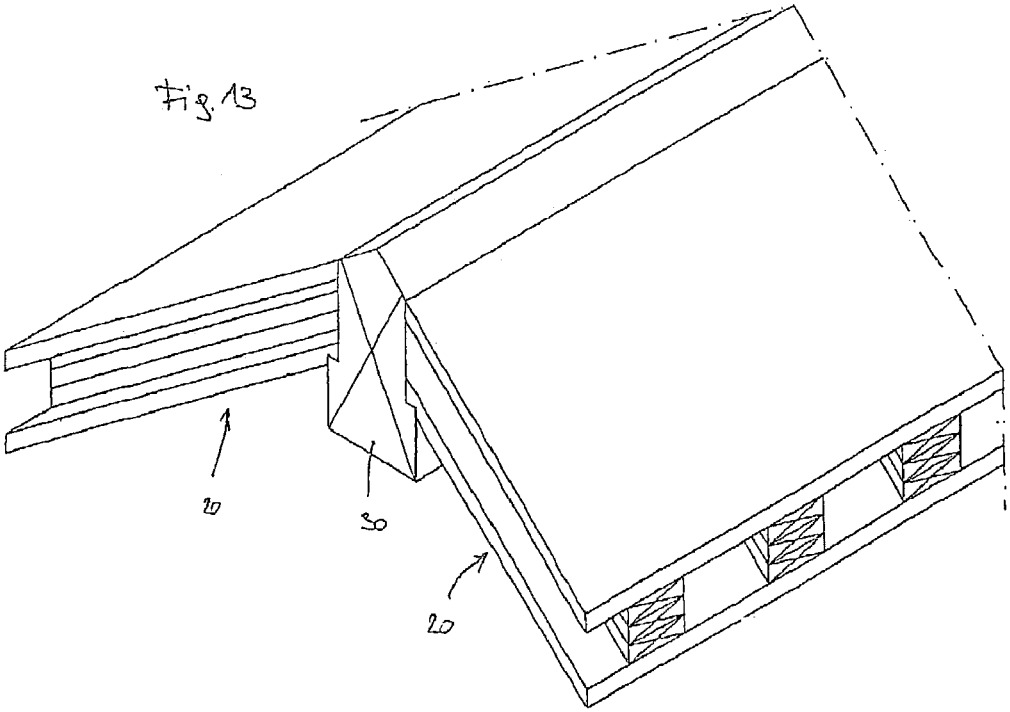
Figure 14:
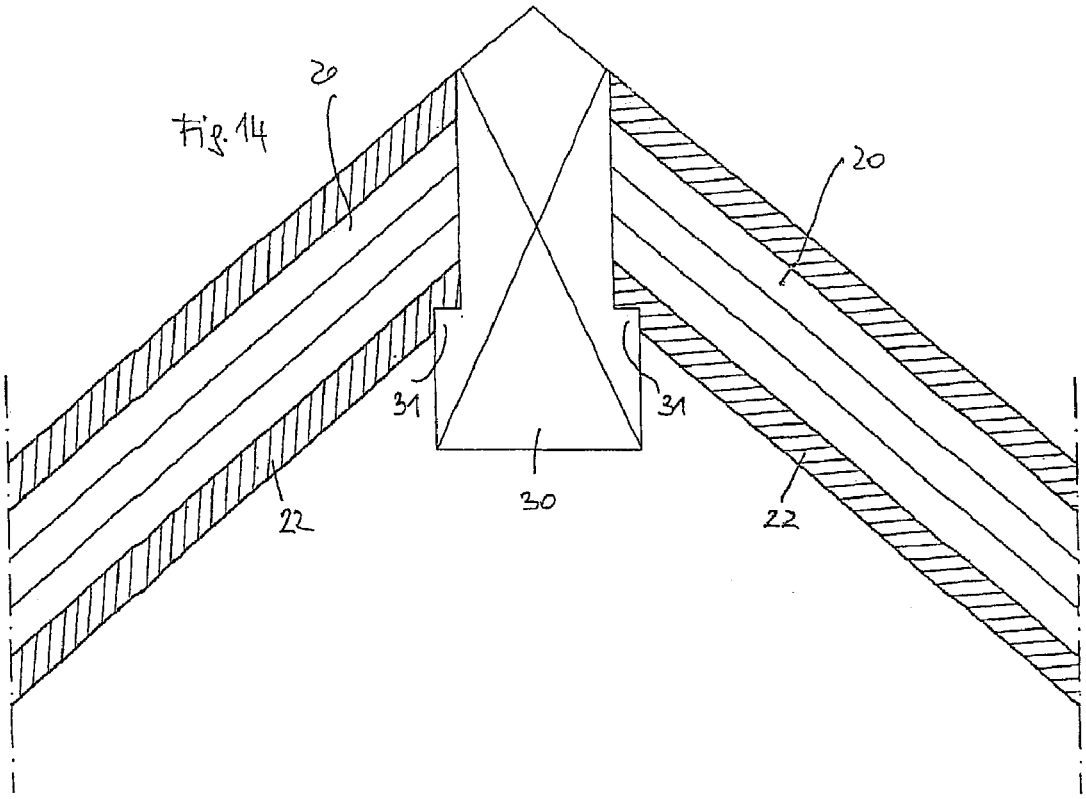
Figure 15:
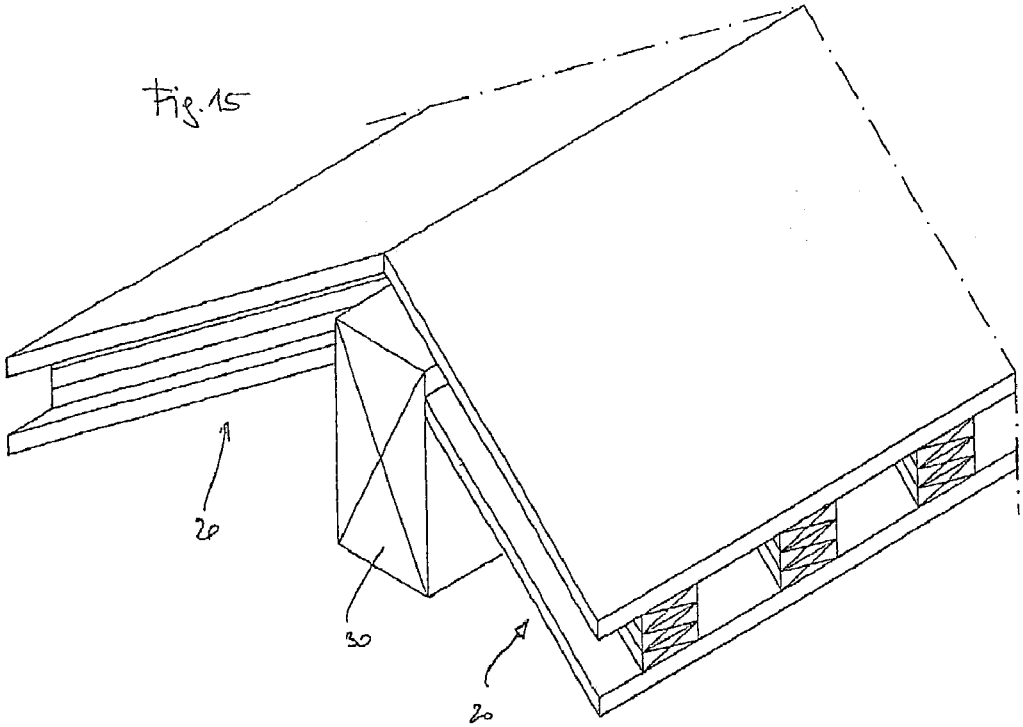
Figure 16:
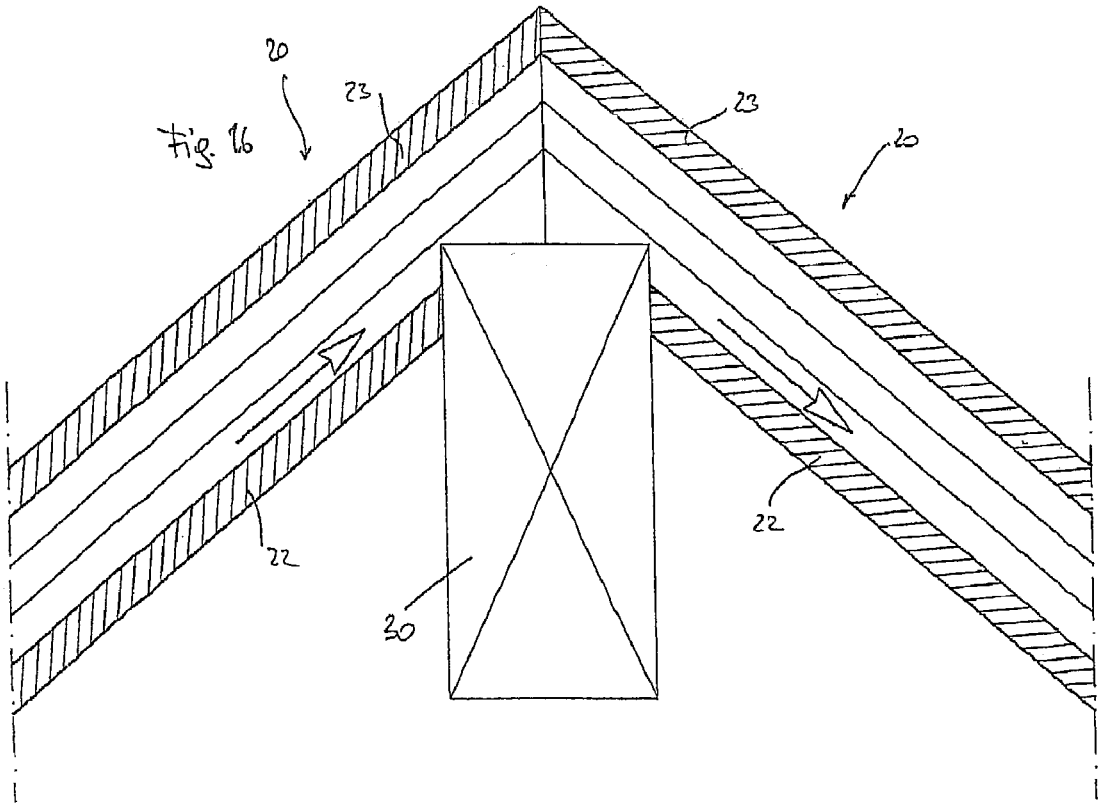
Figure 17:
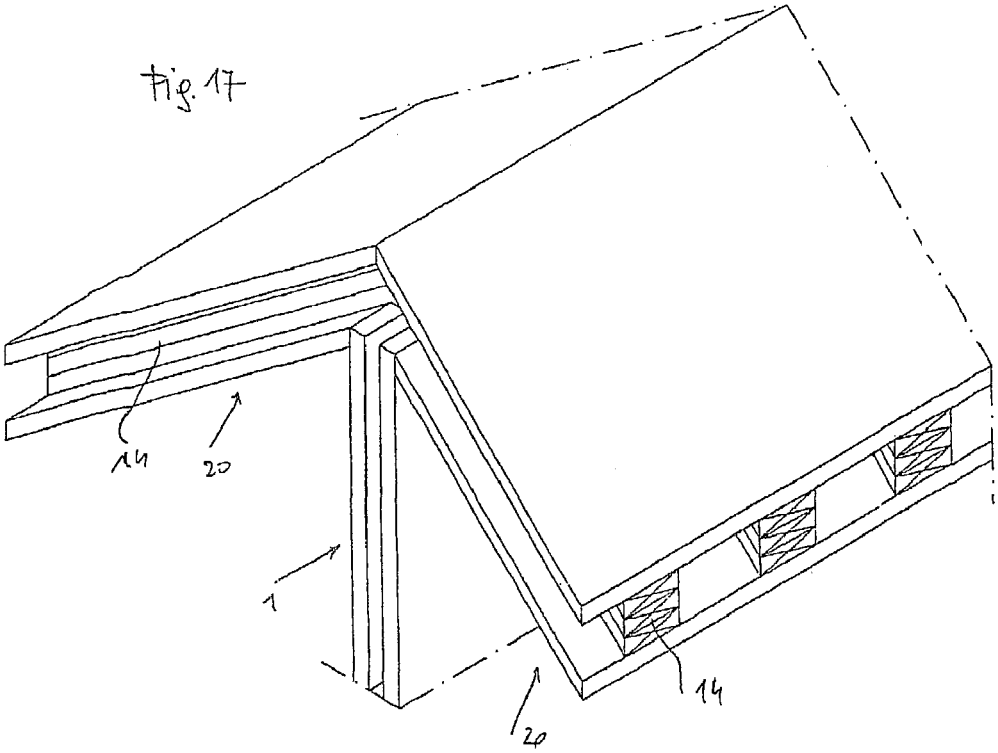
Figure 18:
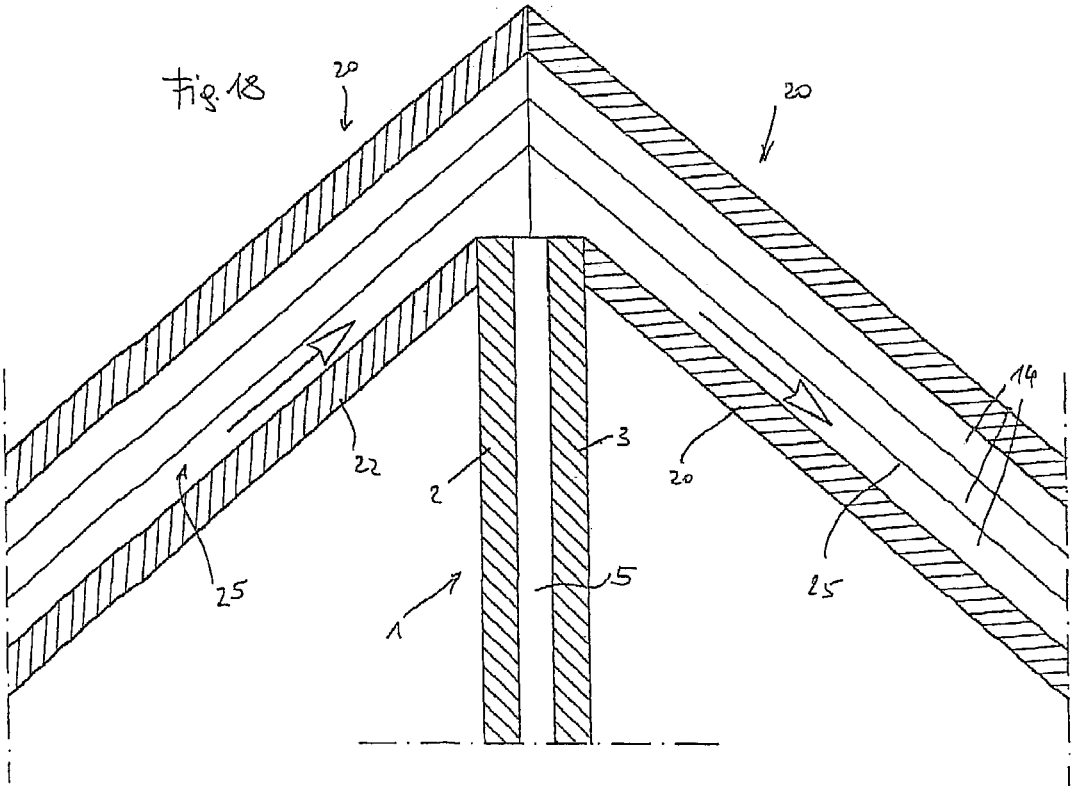
Figure 19:
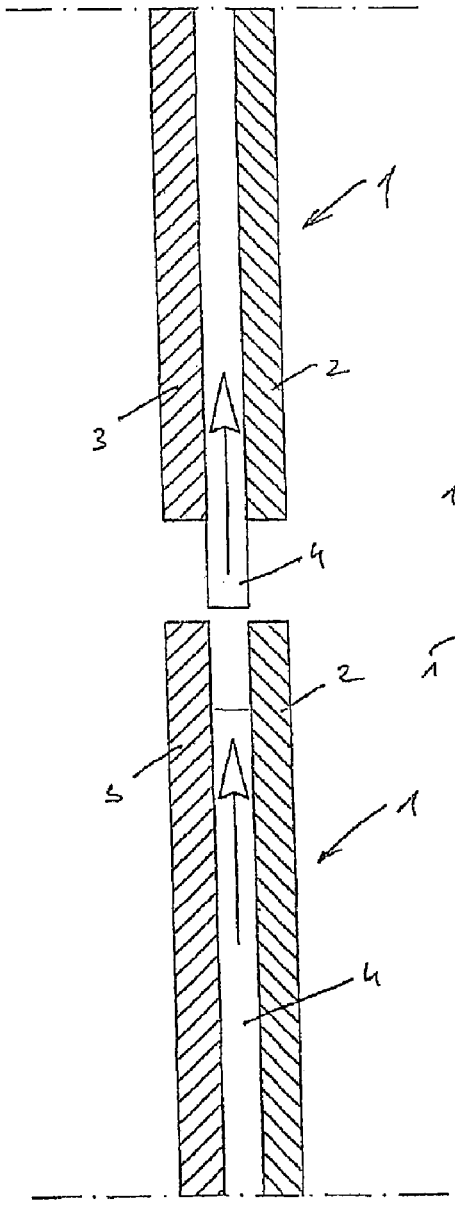
Figure 20:
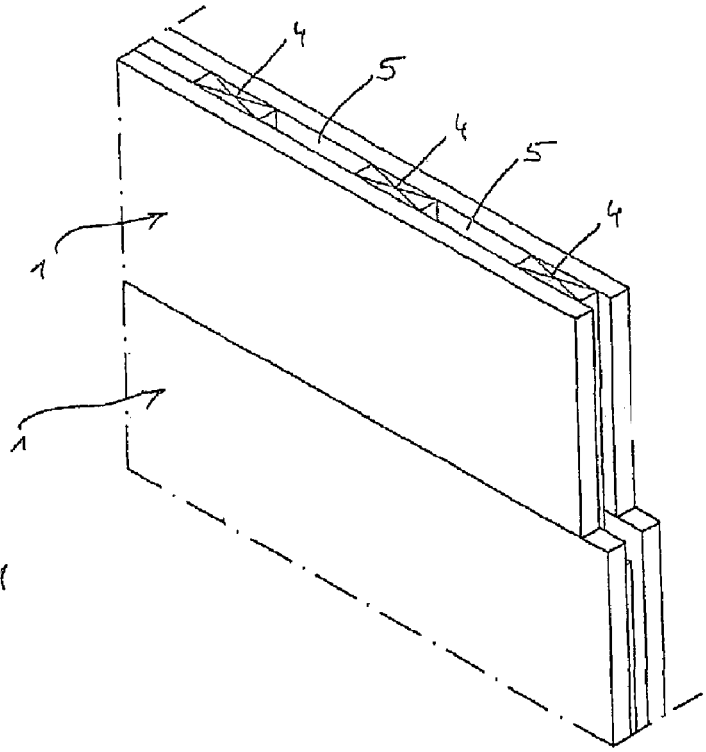
Figure 21:
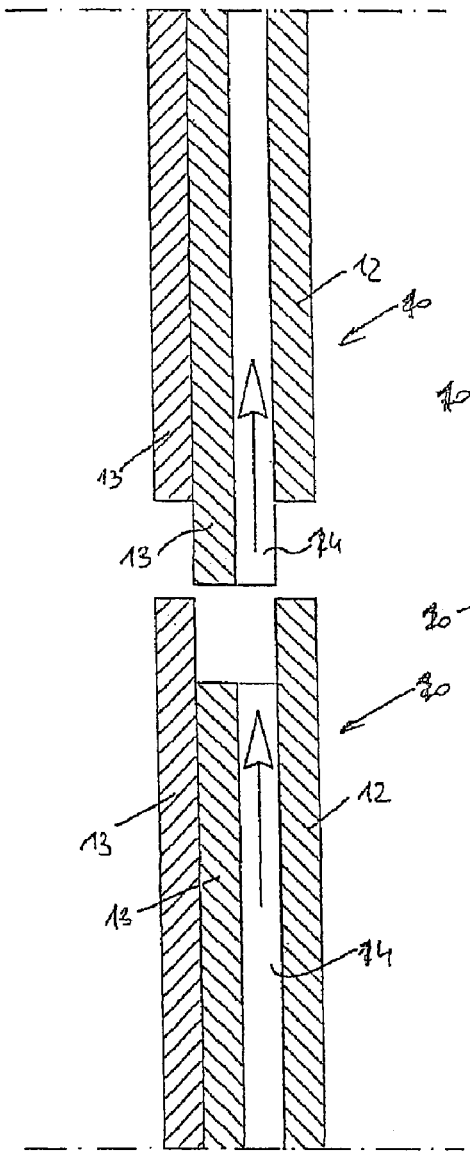
Figure 22:
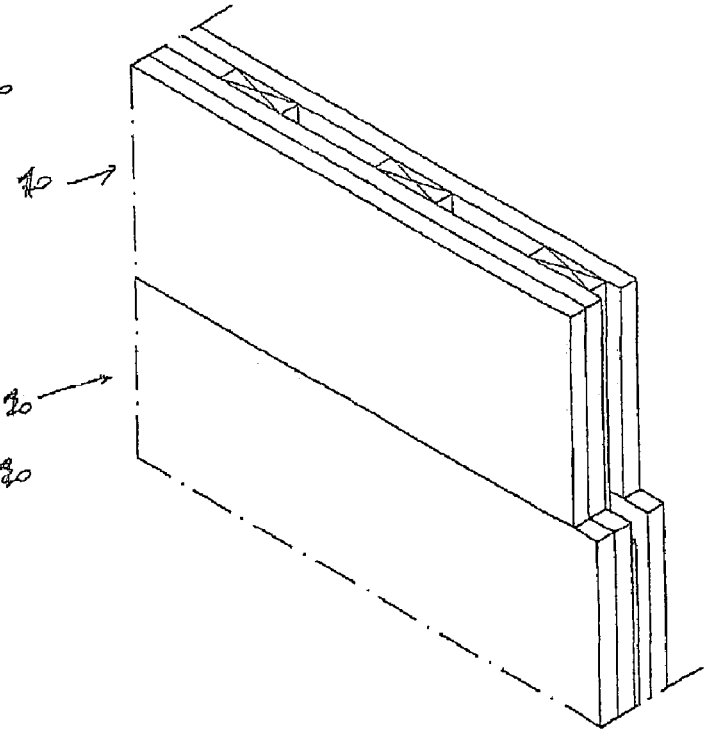
Figure 23:
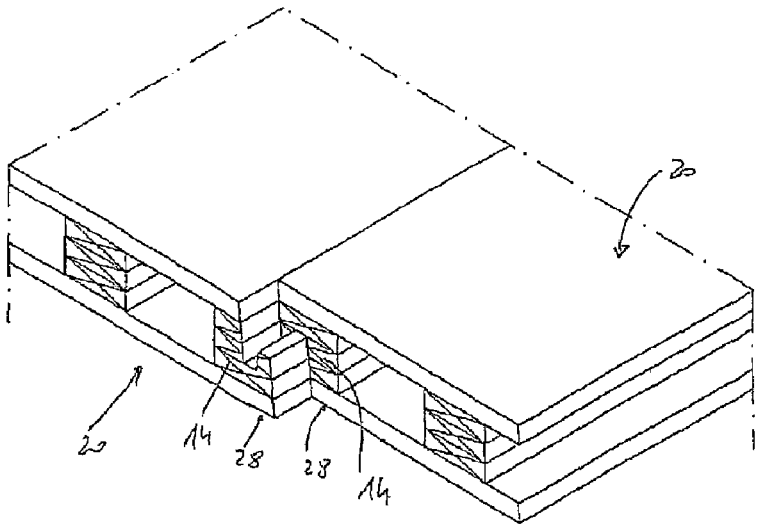
Figure 24:
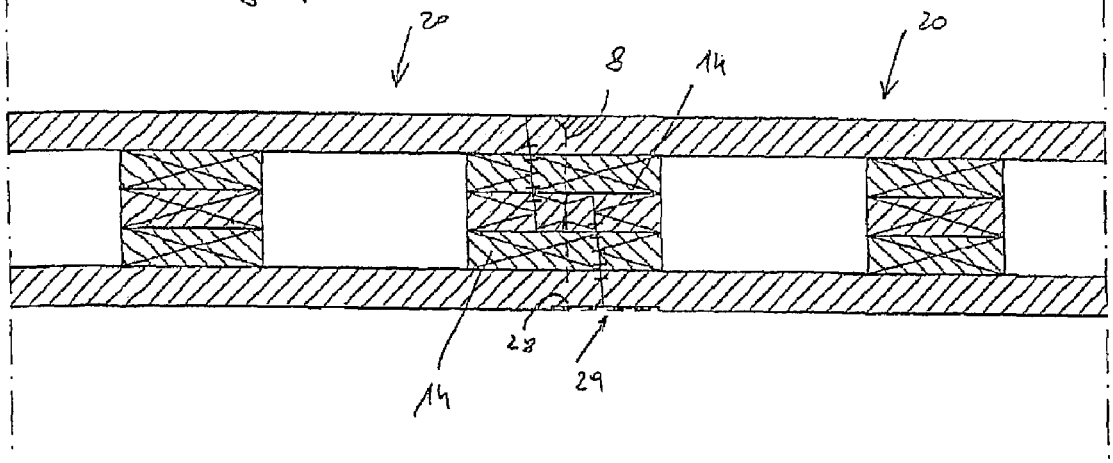
Figure 25:
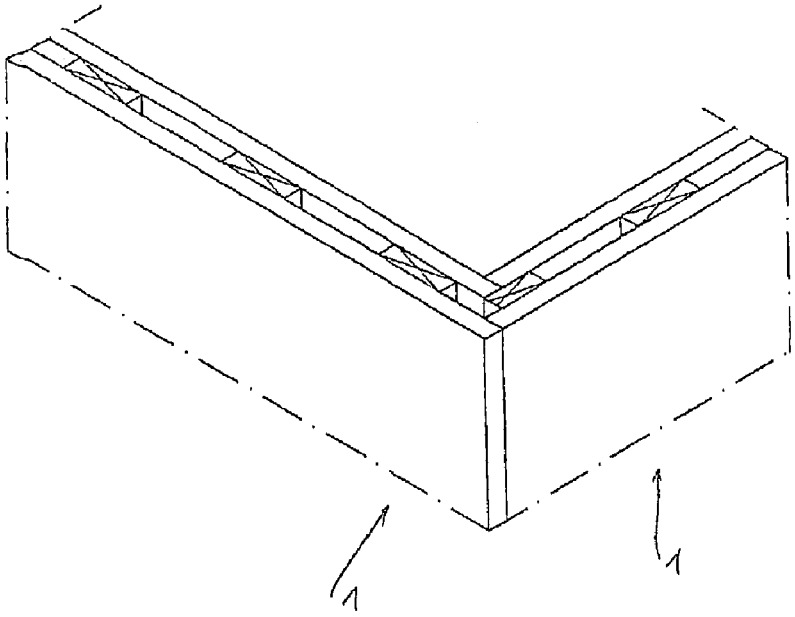
Figure 26:
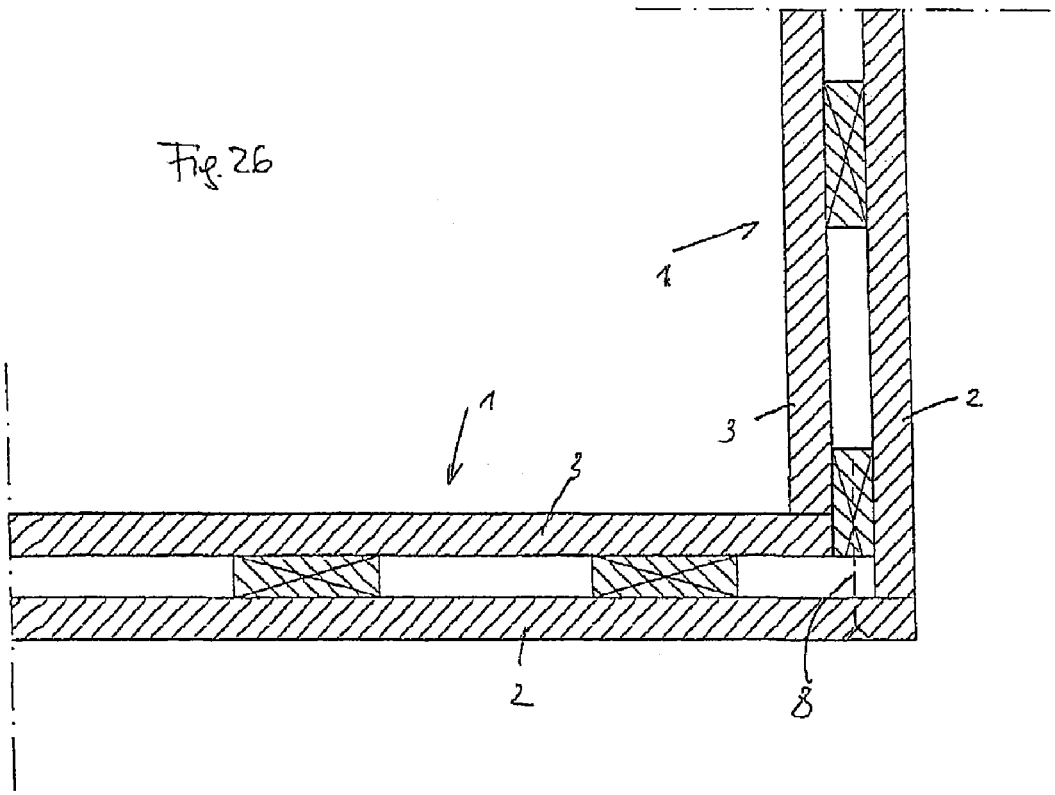
Figure 27:
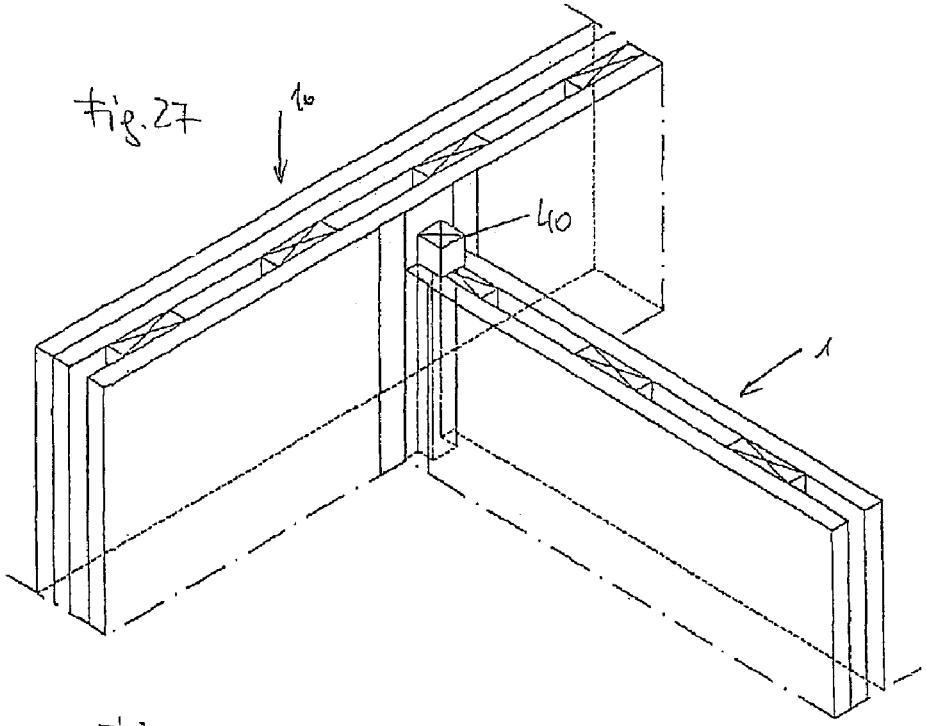
Figure 28:
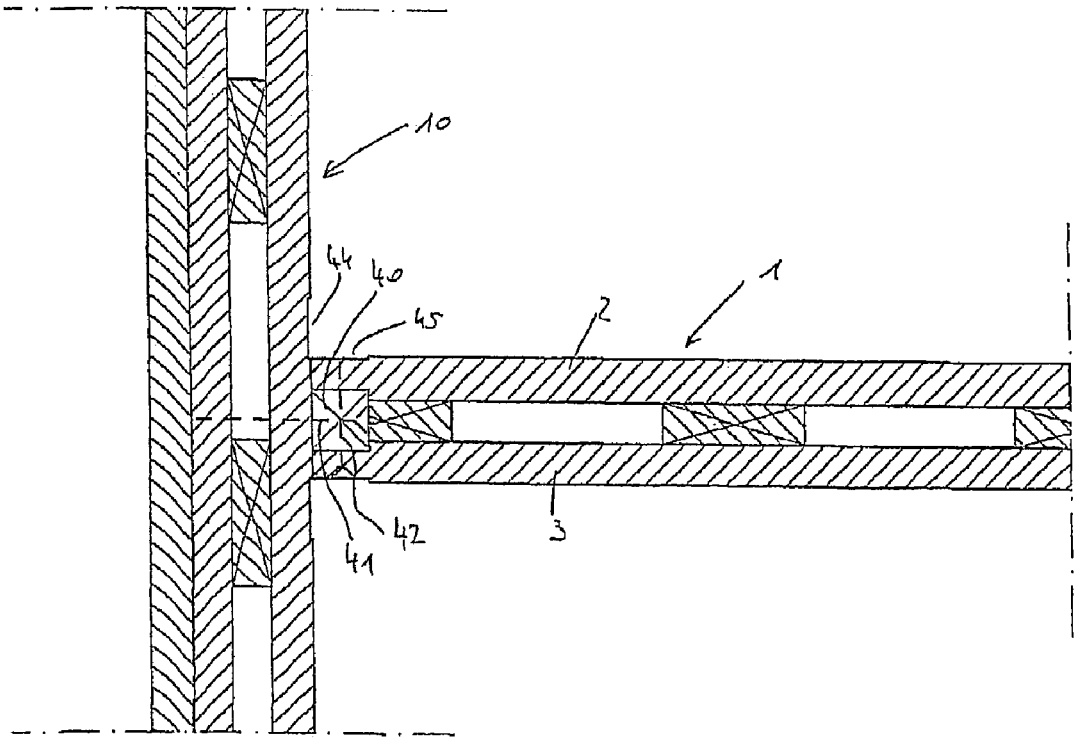
Figure 29:
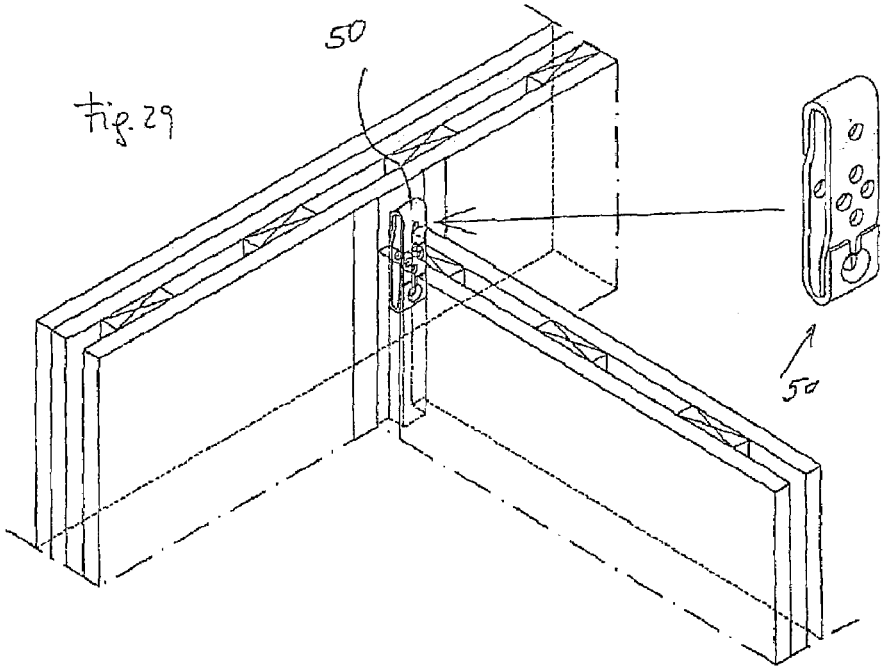
Figure 30:
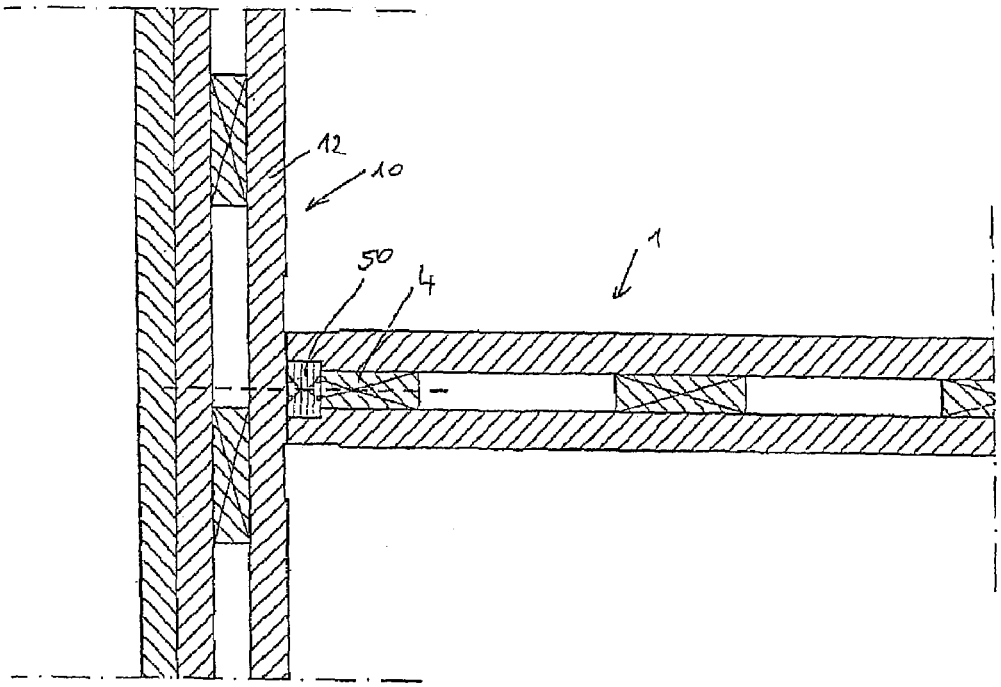
Figure 31:
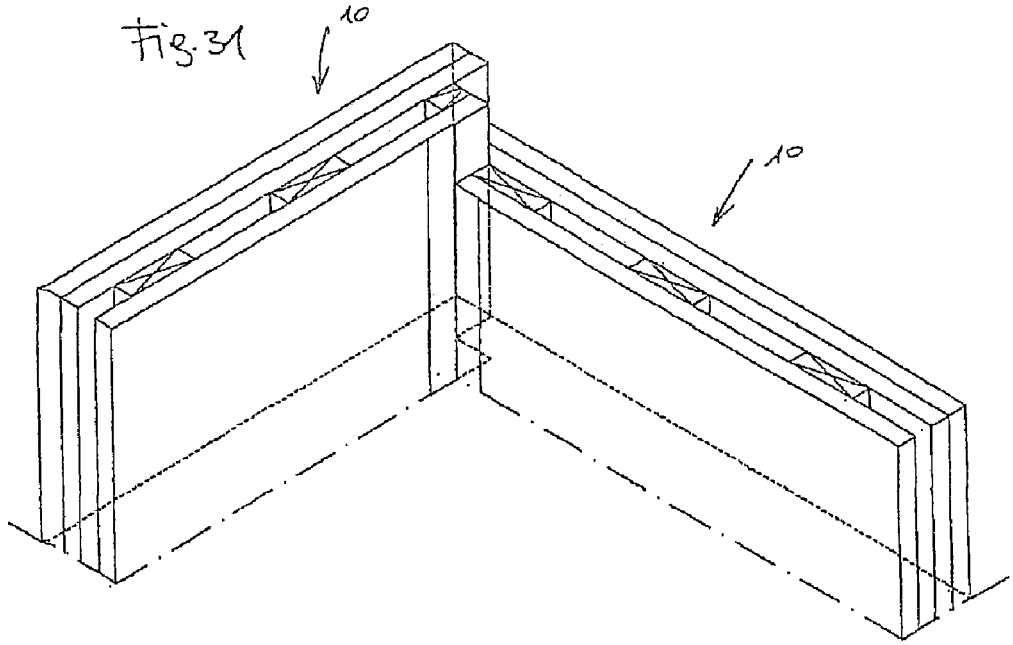
Figure 32:
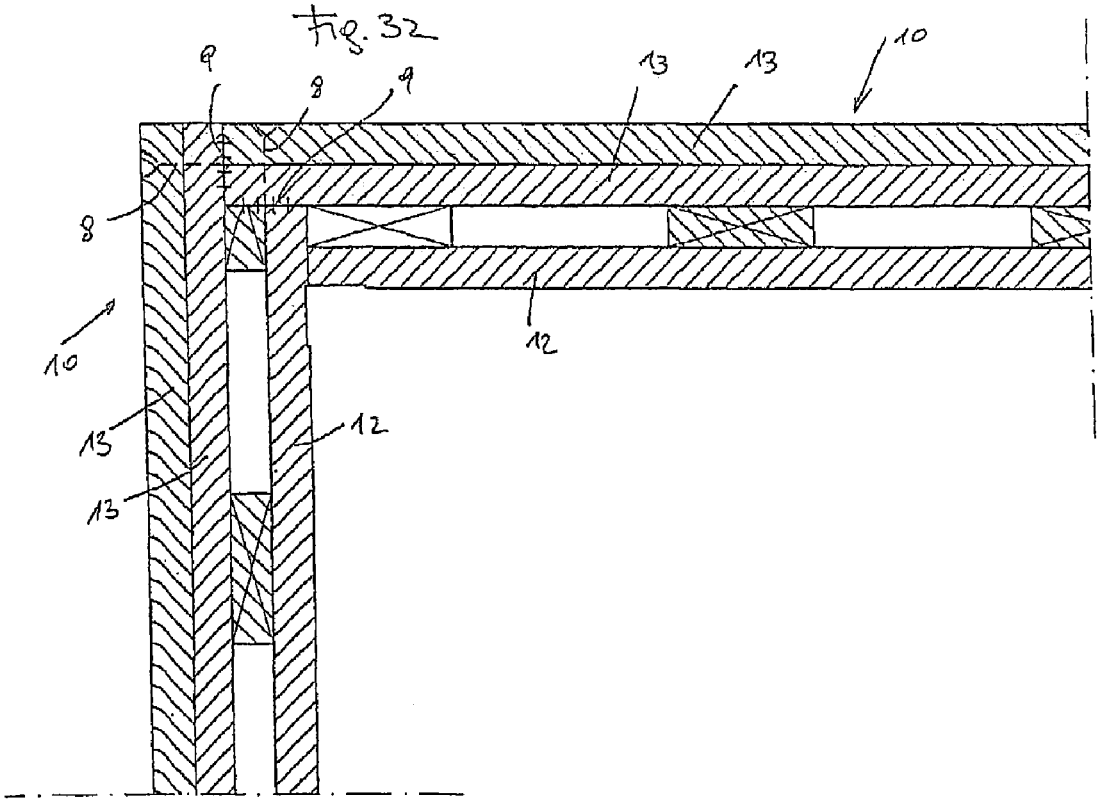
Figure 33:
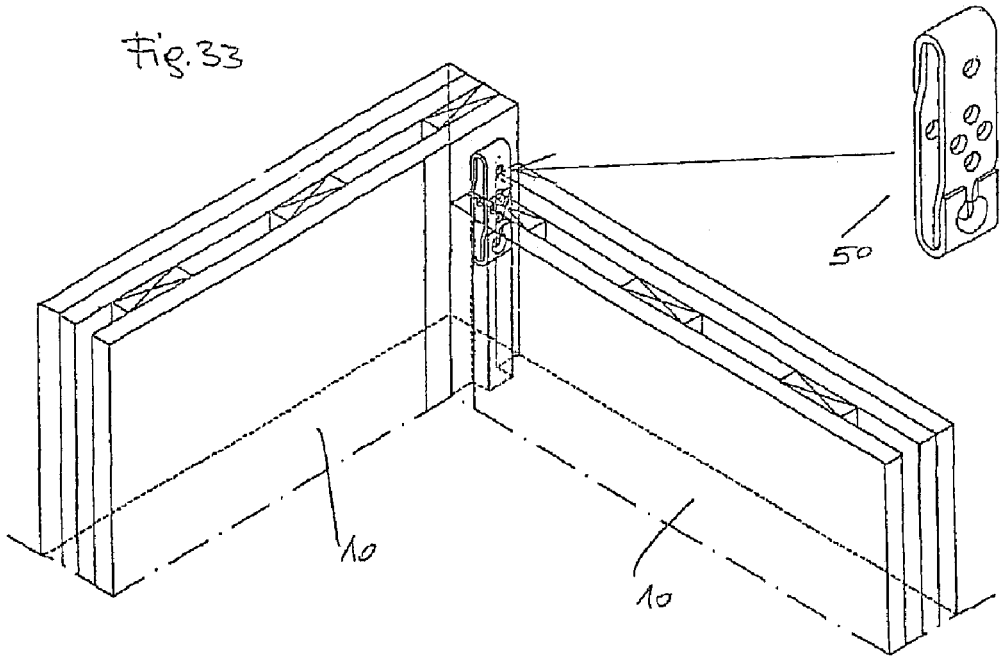
Figure 34:
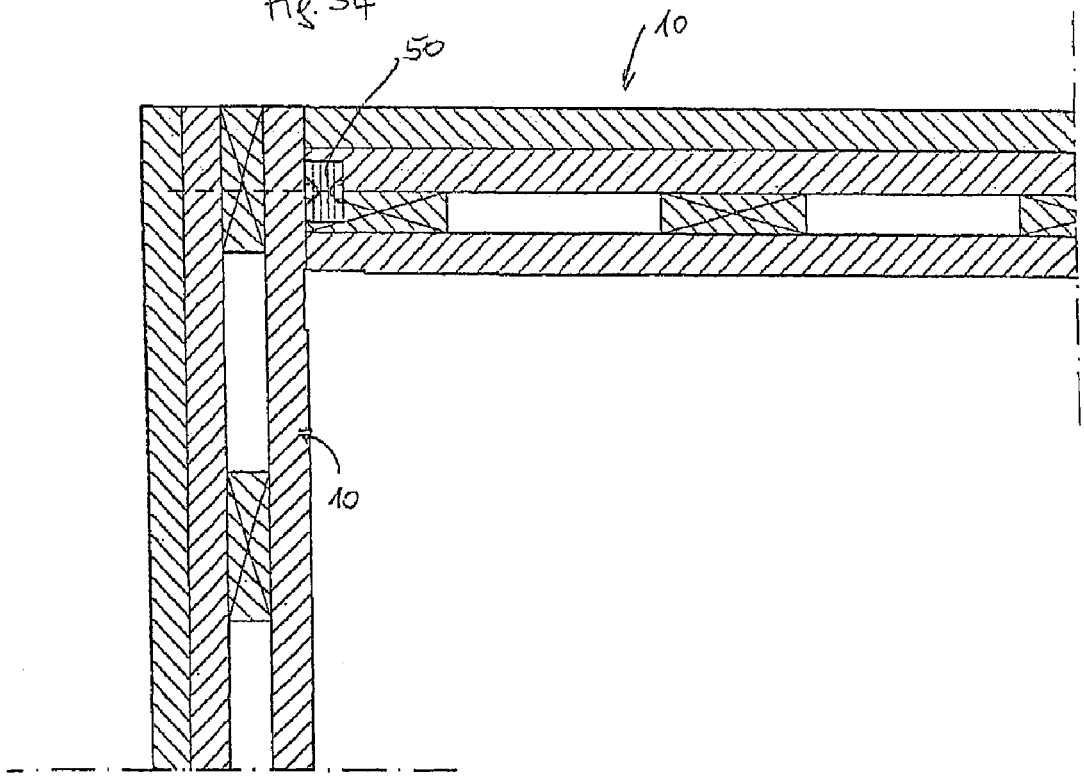
Figure 35:
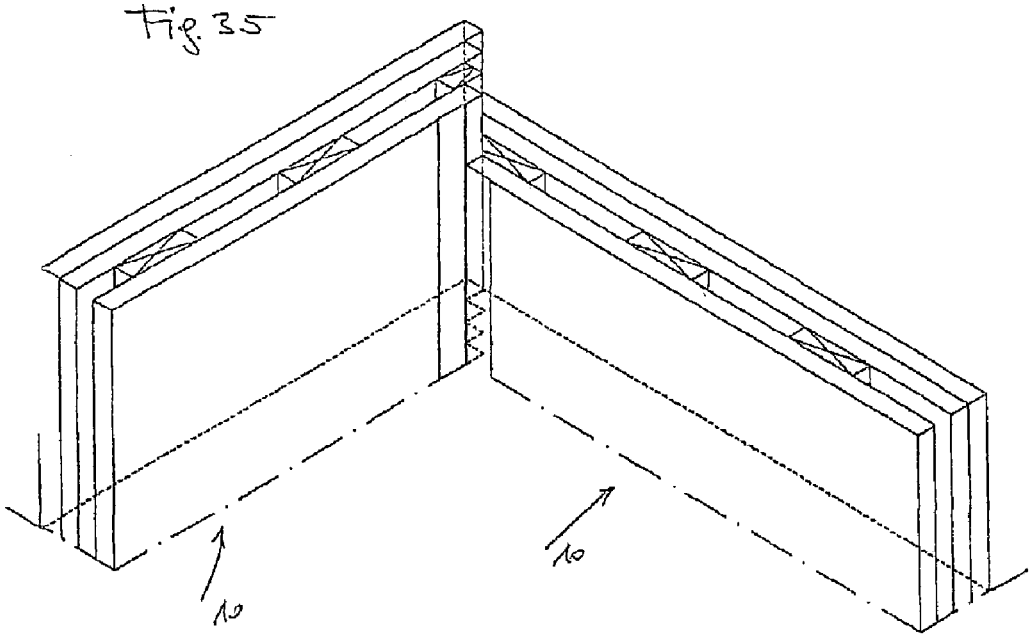
Figure 36:
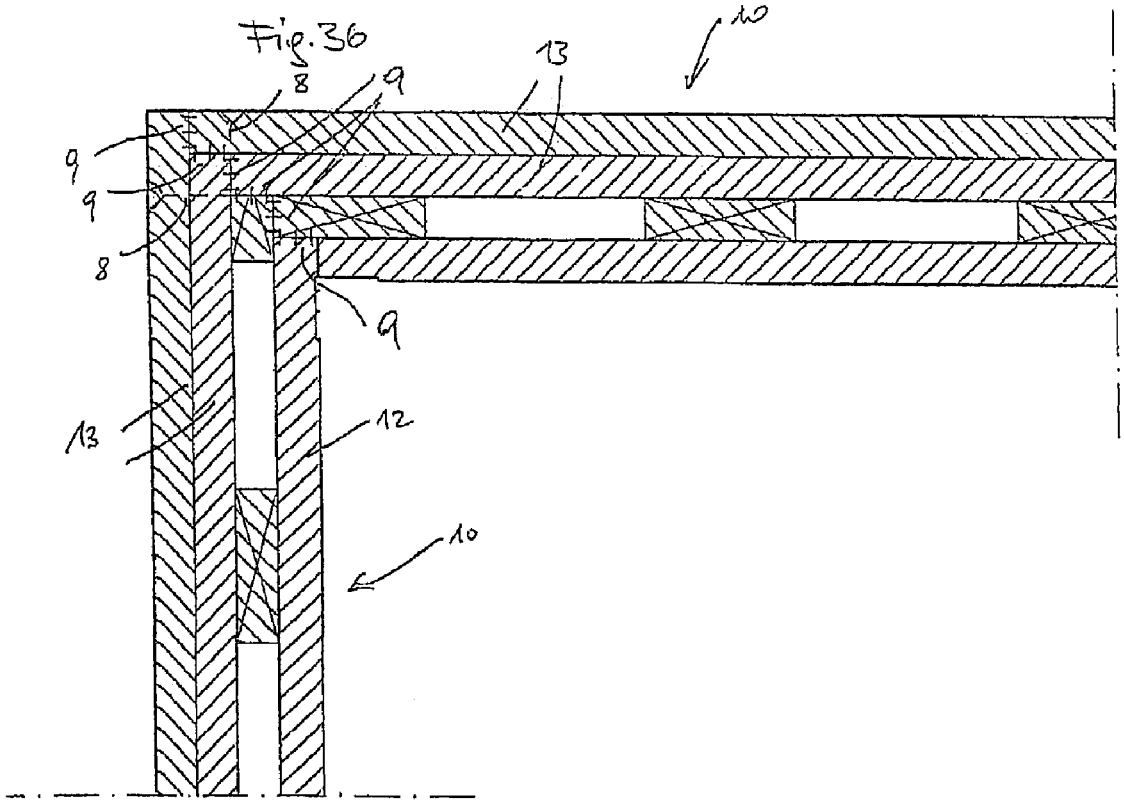
Figure 37:
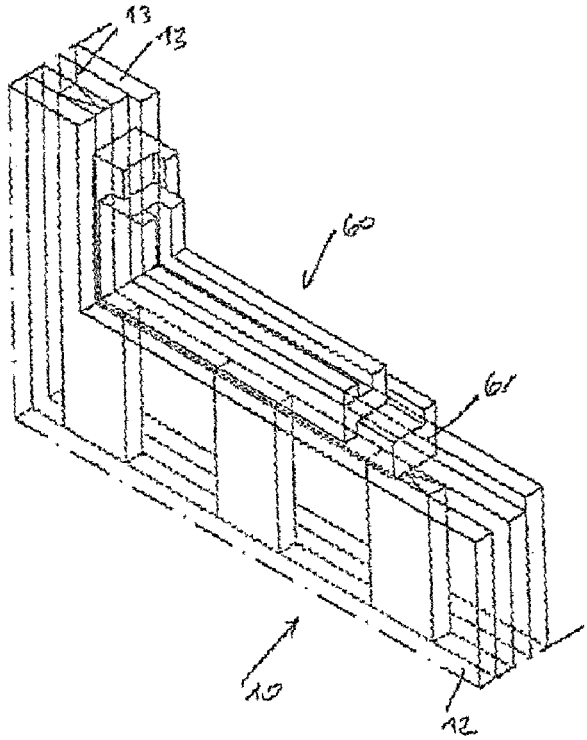
Figure 38:
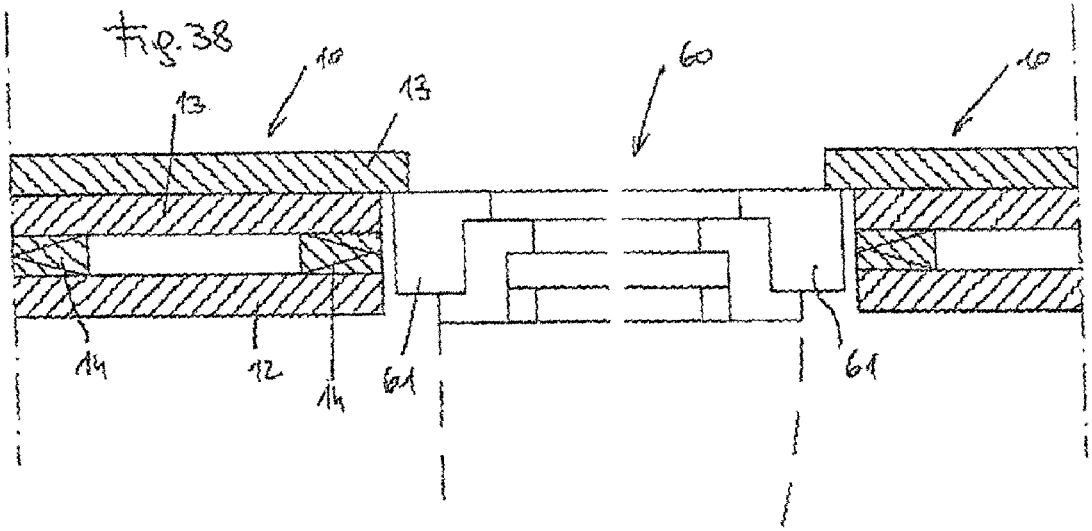
Figure 39:
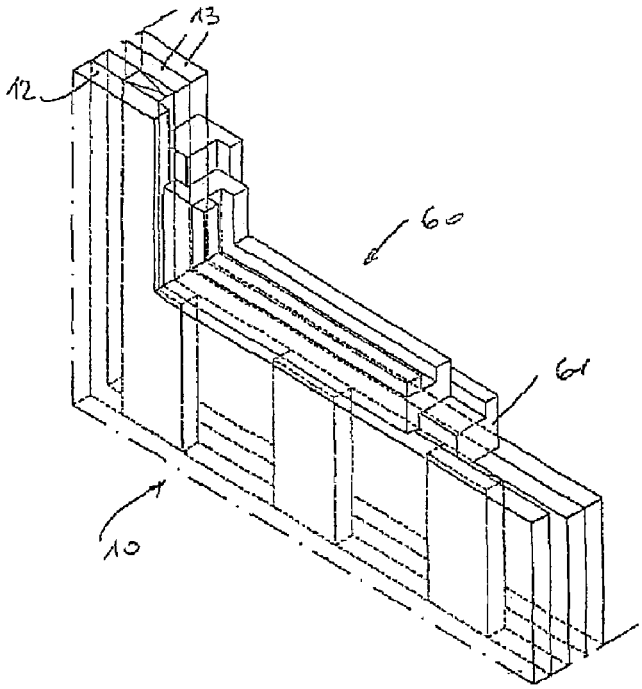
Figure 40:
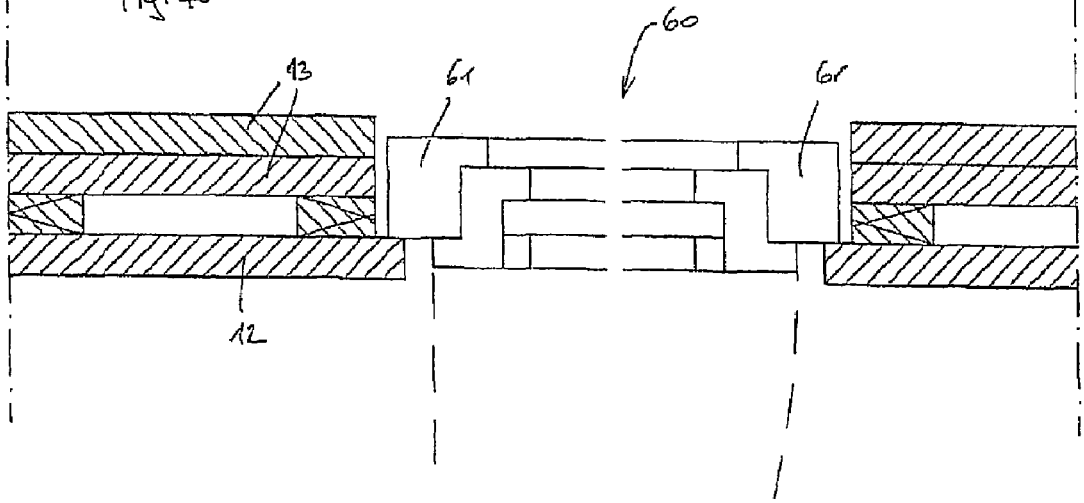
Figure 41:
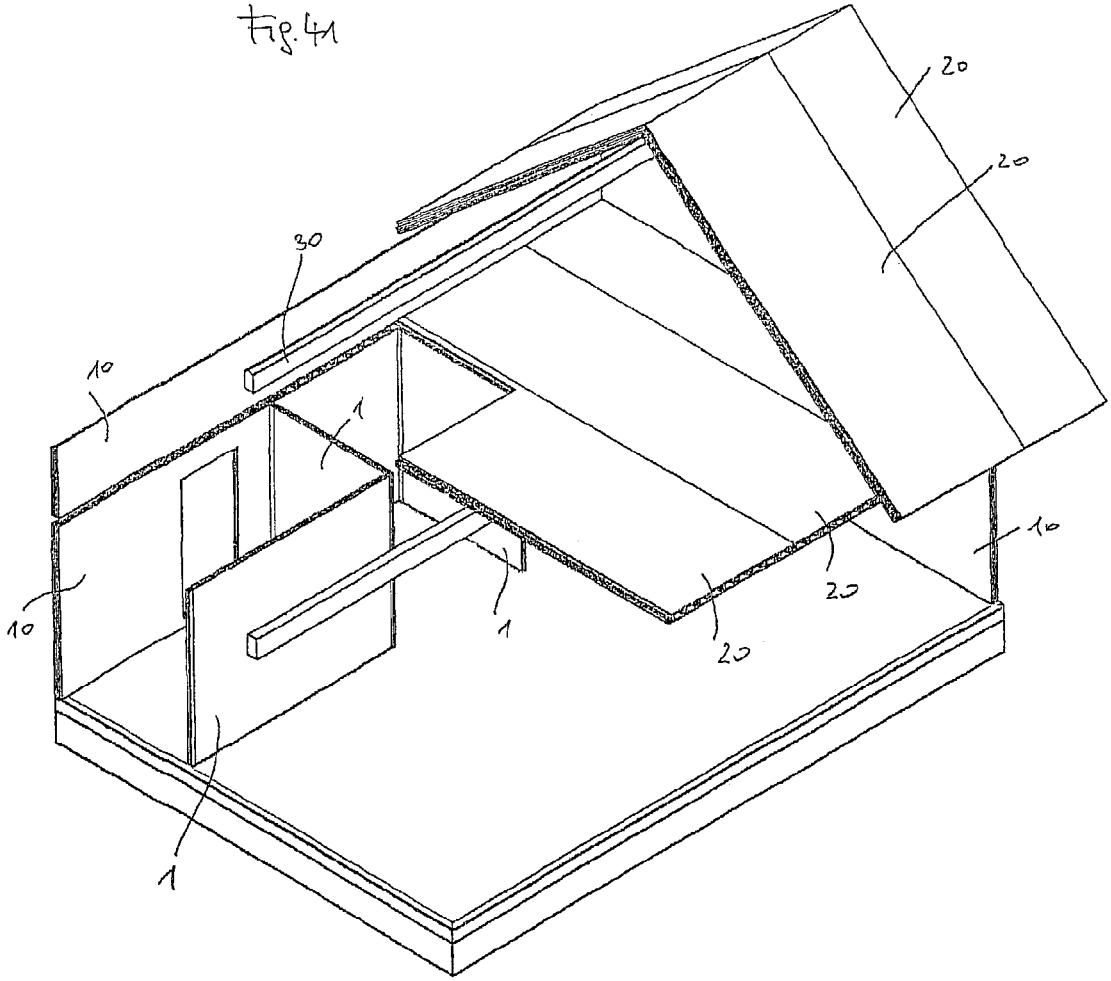

FIG. 3 the outside wall in an oblique view,

FIG. 4 the outside wall in a section,

FIG. 5 a ceiling element or roof element in an oblique view,

FIG. 6 the element from FIG. 5 in a section,

FIG. 7 in an oblique view the connection between the outside wall and ceiling in a section, FIG. 8 the connection between the wall and ceiling in a section, FIG. 9 the outside wall-roof connection in the area of the eaves, FIG. 10 the connection between the wall and roof in the area of the eaves in a section, FIG. 11 a ridge execution in an oblique view, FIG. 12 shows the ridge execution from FIG. 11 in a section, FIG. 13 shows another embodiment of the ridge execution in an oblique view, FIG. 14 shows a section to FIG. 13, FIG. 15 shows another embodiment of a ridge execution in an oblique view, FIG. 16 shows the ridge execution from FIG. 15 in a section, FIG. 17 shows a ridge execution in the area of the inside wall in an oblique view, FIG. 18 shows a section to FIG. 17, FIG. 19 shows in a section a horizontal joint of inside walls located on top of one another, FIG. 20 shows an oblique view of the horizontal joint between the inside walls, FIG. 21 in a section shows a horizontal joint in the area of one outside wall, FIG. 22 shows the horizontal joint of the outside walls in an oblique view, FIG. 23 shows the connection of adjoining ceiling or roof elements in an oblique view, FIG. 24 a section to FIG. 23, FIG. 25 a version of the corner between two inside walls in an oblique view, FIG. 26 shows a horizontal section through the corner version from FIG. 25, FIG. 27 shows the connection of an inside wall to the outside wall in an oblique view, FIG. 28 shows a horizontal section to FIG. 27, FIG. 29 shows another version of a connection between the inside wall and the outside wall in an oblique view with the connecting element shown enlarged, FIG. 30 shows a horizontal section to FIG. 29, FIG. 31 a corner connection between two outside walls in an oblique view, FIG. 32 a horizontal section thereto, FIG. 33 another version of a corner connection between two outside walls with the connecting element shown enlarged, FIG. 34 a horizontal section to FIG. 33, FIG. 35 another version of a corner connection between two outside walls in an oblique view, FIG. 36 a horizontal section to FIG. 35, FIG. 37 in an oblique view a window in the outside wall, FIG. 38 a horizontal section to FIG. 37, FIG. 39 another version of a window in the area of an outside wall, FIG. 40 a horizontal section thereto and FIG. 41 a building as claimed in the invention, partially cutaway and in an oblique view.

Figure 1:
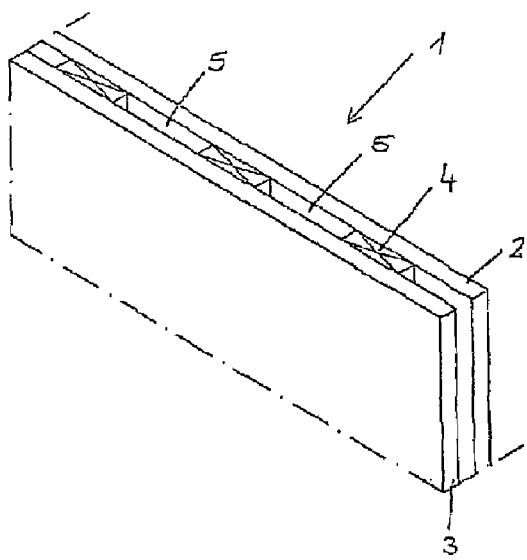
FIG. 1 shows the inside wall in an oblique view.
Figure 2:
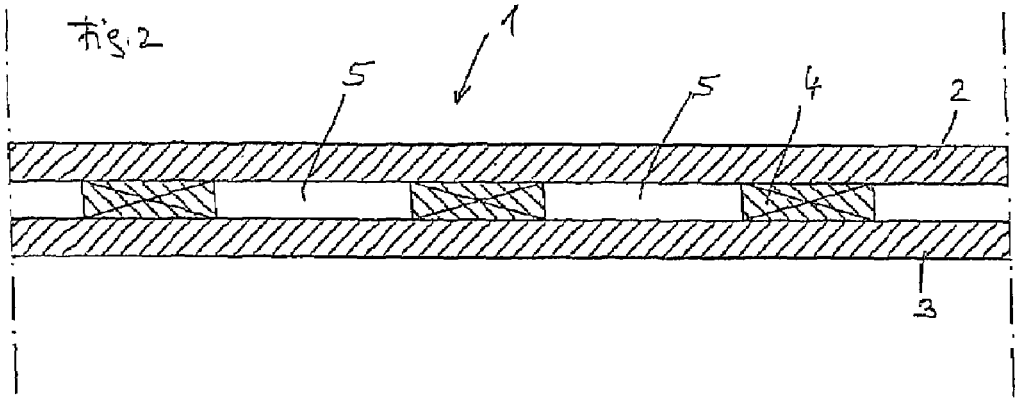
FIG. 2 shows the inside wall in a section.

The inside wall 1 shown in FIGS. 1 and 2 (partially) consists of two sheets 2, 3 of particle board which are aligned parallel to one another, which are located at distance from one another and which can have the same or different thicknesses. The particle board sheets 2 and 3 are connected to one another via spacers 4. The spacers 4 can be strips or blocks. The inside wall shown in FIGS. 1 and 2 is produced for example at the manufacturer's plant with the dimensions and edge formations required at the time, the sheets 2 and 3 being joined to the spacers 4 in the manufacturer's plant for example by gluing. Due to the spacers 5 there are cavities 5 between the sheets 2 and 3 of the inside wall 1. These cavities 5 can be used to accommodate the plumbing and power in the inside wall 1. These cavities 5 can also be used for temperature control of the building (heating and/or cooling) by connecting them to the corresponding heating and/or cooling devices.

The cavities 5 can if necessary also be provided with a filling in order to match the insulation properties, especially the noise control properties of the inside wall 1, to the respective requirements. In particular, filling with a material which changes the natural frequency of the inside wall 1 such that it has good noise control properties is intended.

The filling can also be chosen such that the building as claimed in the invention has at least in part the properties of a solid structure.

The outside wall 10 shown in FIG. 3 has in its (inner) side facing the bounded space a particle board sheet 12 and on its outside two particle board sheets 13 which are joined, for example, glued, directly to one another. The double sheet 13 is, as is described using FIGS. 1 and 2 for the inside wall 1, connected via spacers 14 to the inside sheet 12 so that cavities 15 arise. The outside wall 10 can, as has been described for the inside wall 1, be produced in the manufacturer's plant with he required dimensions and edge executions.

The sheet-shaped element 20 which is shown in FIGS. 5 and 6 and which can be used for the ceiling and/or roof consists of for example two particle board sheets 22 and 23 which are connected to one another via spacers 24. For the ceiling element and/or roof element 20 a greater distance between the sheets 22 and 23 (sheets of particle board) is advantageous; this can be achieved by thicker spacers 24 (blocks or strips). In the embodiment shown greater thickness of the spacers 24 is achieved by their being assembled in several layers (in the example: three layers). The cavities 25 provided between the spacers 24 and the sheets 22 and 23, as is shown in FIG. 6, can be filled by thermal insulation 26 and/or a filler 27. Alternatively the ceiling elements and/or wall elements 20, as has been described for the outside walls 10 and the inside walls 1, can also be used for installing the plumbing and gas/electrical and/or for temperature control of the building out of the described sheet elements.

FIGS. 7 and 8 show a connection between two outside walls 10 located on top of one another and a ceiling element 20 located with its edge between them. On the edge of the sheets 22, 23 of the ceiling element 20 there are openings 28 which are flush with the cavities 15 of the outside wall elements 10 so that the cavities 15 in the outside wall elements 10 are connected to the cavities 25 in the ceiling element 20, as is shown in FIG. 8 by the arrows.

FIGS. 9 and 10 shows the execution of the eaves between the outside wall 10 and a roof element 20 which is made as described using FIGS. 5 and 6. The upper edges of the sheets 12 and 13 of the outside wall 10 are, as shown in FIG. 10, worked, and the sheet 22 is likewise routed as shown in FIG. 10 such that a slip-proof connection between the outside wall 10 and the roof element 20 is ensured. In the area of the upper ends of the cavities 15 in the outside wall 10 there are through openings 28 in the sheet 22 of the roof element 20 so that the cavities 15 in the outside wall 10 communicate with the cavities 25 in the roof element 20, as is illustrated by the arrow in FIG. 10.

FIGS. 9 and 10 also show that the outside wall 10 is arranged such that its double sheet 13 points to the outside and the sheet 12 points to the inside of the space.

FIGS. 11 and 12 show one embodiment for the execution of a ridge between two roof elements 20, in the area of the ridge there being a solid wood purlin 30. In the embodiment shown in FIG. 11 the purlin 30 is located underneath the roof elements 20 and fits with its upper corners 31 into corresponding grooves in the lower sheets 22 of the roof elements 20. Furthermore, the purlin 30 with its oblique surfaces 32 which are provided at the top adjoins the upper edge areas of the sheets 22 of the roof elements 20. Thus, there is reliable support of the roof elements 20 in the ridge area.

FIGS. 13 and 14 show a different type of execution of a ridge with a purlin 30. In this embodiment the purlin 30 extends as far as the top of the roof elements 20 and is bevelled at the top according to the progression of the alignment of the roof elements 20. The purlin 30 fits with two shoulders 31 in the corresponding grooves in the lower sheets 22 of the roof elements 20 so that there is reliable support of the roof elements 20 in the ridge area.

FIGS. 15 and 16 show a third alterative for the execution of a ridge which is intended for a roof version with lower expected loads. In this version the lower sheets 22 of the roof elements 20 which are made set-back relative to the ridge-side edges of the upper sheets 23 of the roof elements 20 adjoin the lateral surfaces of the purlin 30.

When there is an inside wall 1 in the ridge area of a roof formed from two roof elements 20, the ridge can be made as is shown in FIGS. 17 and 18. Here the lower sheets 22 of the roof elements 20 adjoin the upper horizontal edges of the sheets 2 and 3 of the inside wall 1 so that the cavities 5 in the inside wall 1 communicate with the cavities 25 in the roof elements 20.

If higher inside walls 1 are needed when a building is being erected as claimed in the invention, individual inside wails 1 as shown in FIGS. 19 and 20 can be placed on top of one another, forming a horizontal joint. Here it is preferred if the spacers 14 on the lower edge of the upper inside wall 1 are made elongated, therefore project over the lower edge of the inside wall 1, and the upper ends of the spacers 14 are made correspondingly set back between the sheets 2 and 3 of the lower inside wall 1 so that a form-fitted connection in the area of the horizontal joint between the inside walls 1 is ensured without the cavities 5 in the inside walls 1 being interrupted.

FIGS. 21 and 22 show a similar execution of a horizontal joint between the outside walls 10 located on top of one another, here not only the spacers 14, but also one of the two sheets 13 projecting on the lower edge of the outside wall 10 and on the upper edge of the lower outside wall 10 being set back accordingly so that here a form-fitted connection between the outside walls 120 in the area of the horizontal joint is also formed without the cavities 125 being interrupted.

In the embodiment shown in FIG. 23 for a connection of ceiling elements or roof elements 20 located next to one another the elements in the area of their contiguous edges viewed in cross section are profiled in the manner of hooks, so that a hooked fold-like connection results between adjacent ceiling elements or roof elements 20. To secure the connection, in the area of the hooked fold binding screws 8 are driven and/or there is the gluing indicated in FIG. 24. FIG. 24 also shows that in the area of the bottom of the joint between adjacent ceiling elements or roof elements 20 there is grooving 28 which is filled by a covering 29, for example in the form of a plastic or wood strip, so that the butt joint, especially after the covering 29 is levelled out, is no longer visible from underneath. It is apparent that the hooked fold-like execution between adjacent ceiling elements or roof elements 20 is made with the inclusion of the spacers 14 which in this case are made continuous preferably at least in the edge area (strip-shaped) in order to achieve the necessary strength.

In addition to connection by screws 8, the fold connection can also be ensured by gluing.

FIGS. 25 and 26 shows a corner connection between the inside walls 1 which meet one another at an angle. In the area of the meeting edges the inner sheets 3 are set back relative to the outside sheets 2 of the inside walls 1 so that the arrangement which is shown in FIG. 26 results, its being possible to glue the corner connection and/or to secure it by screws 8.

In the connection of one inside wall 1 to the outside wall 10 shown in FIGS. 27 and 28, in the connection area there is a beam 40 which is connected to the outside wall 10 with screws 41. The beam 40 fits between the sheets 2 and 3 of the inside wall 1, its being possible to provide the inside surfaces of the sheets 2 and 3 with the corresponding grooves. The connection between the beam 40 and the inside wall 2 is ensured by screws 42 and/or gluing. In the area of the two inside corners in the angled area between the outside wall 10 and the inside wall 1 there are grooves 44, 45 which for example accommodate a plastic angle (not shown) which is levelled out. This ensures that even when the wood is working, no gaps can form in the connection area between the outside wall 10 and the inside wall 1.

FIGS. 29 and 30 shows one alternative execution of the connection of the inside wall 1 to the outside wall 10. To do this, on the one hand for example metal hooks 50 are screwed to the sheet 12 of the outside wall 10 and on the other hand to the edge-side spacer 4 of the inside wall 1 (see FIG. 29) so that a form-fitted connection between the inside wall 1 and the outside wall 10 can be produced by hooking-in the inside wall from the top, therefore by movement down.

In the example shown in FIGS. 31 and 32 for a corner connection, between two outside walls which meet one another at an angle the sheets 12 are set back relative to the two-layer sheet 13 so that the corner connection shown in FIG. 32 results, in which the sheets 13 of one outside wall 10 abut the edge of the sheets 13 of the other outside wall 10. The inner sheet 12 of one outside wall 10 abuts the inside surface of the inner sheet 12 of the other outside wall which adjoins the inner sheet 13 of the double sheet 13 of the other outside wall 10. In the area of the adjoining sheet edges there can be a glue connection 9 and in addition or alternatively joining by screws 8.

FIG. 33 shows one embodiment for a corner connection between two outside walls 10 which has been produced for use of retaining claws 50, as have also been described using FIGS. 29 and 30 for connection of one inside wall 1 to the outside wall 10.

FIGS. 35 and 36 show a corner connection between two outside walls 10 which has been modified relative to FIGS. 31 and 32 such that the double sheets 13 of the outside walls 10 are made stepped on the edge side and the inner sheet 12 of one outside wall 10 adjoins the spacer 14 of the other outside wall 10. Here, in addition or alternatively to glue connections 9 there can also be screws 8 in order to secure the corner connection between the outside walls 10.

FIGS. 37 and 38 show the execution of a window 60 which opens to the inside in a corresponding cutout in the outside wall 10. It can be seen especially from FIG. 38 that the window case 61 is connected to the outside sheet 13 of the double sheet of the outside wall 10, which sheet 13 is made to project in the area of the window opening, so that stop strips are unnecessary since the corresponding execution can be made by the corresponding sinking of the sheets 13 in the manufacture of the outside wall 10 and the window opening in it.

The analogous applies to the execution of a window which opens to the inside according to FIGS. 39 and 40. A stop strip is not necessary here either since the window case 61 is connected directly to the inner sheet 12 which is made projecting in the area of the window opening in the outside wall 10.

FIG. 41 shows a building produced as claimed in the invention from the inside walls 1, outside walls 10, ceiling elements 20 and roof elements 20 which were described previously using FIGS. 1 to 40. It is apparent that the inside walls 1 in the horizontal direction are made continuously in one piece. The outside walls 10 pass over the entire length and width of the building from FIG. 41 in one piece and are horizontally joined on top of one another simply to achieve the necessary height, and the horizontal joint can be made as shown in FIGS. 21 and 22. The execution of the ridge in combination with the purlin 30 provided there can be made as described above using FIGS. 11 to 16. In the area of the eaves, therefore where the roof elements 20 adjoin the outside wall elements 10, the execution described using FIGS. 9 and 10 is possible.

The invention claimed is:

1. A building, comprising:

one of a heating device and a cooling device; and derived timber product sheets serving as outside wall sheets (10), inside wall sheets (1), and at least one of and ceiling sheets (20) and roof sheets (20), each of the derived timber product sheets having at least one inside panel (2, 12, 22) of timber product joined to at least one outside panel (3, 13, 23) of timber product, the inside panel and the outside panel spaced apart from one another, at a distance, by spacers (4, 14, 24), each of the derived timber product sheets being continuously in one piece at least in one direction, and being in dimensions required for a particular use and with edge executions necessary for the particular use, each of the derived timber product sheets having cavities (5, 15, 25) between the inside panel and the outside panel (2, 3; 12, 13; 22, 23), wherein, the cavities (5, 15, 25) of the inside wall sheets (10) comprise connections to the one of the heating device and the cooling device, the connections connecting the cavities of inside wall sheets (10) to the one of the heating device and cooling device, in an area of adjoining edges of the ceiling sheets (20) and the roof sheets (20), the adjoining edges are profiled diametrically opposed each other, and the adjoining edges of the ceiling sheets (20) and the roof sheets (20) are made of hooked folds.

2. A building as claimed in claim 1, wherein, in a ridge area, adjoining horizontal edges of the roof sheets (20) are supported by a purlin (30).

3. A building as claimed in claim 2, wherein the inner sheets (22) of the roof sheets (20) have profiling which is diametrically opposed to profiling in an upper area of the purlin (30).

4. A building, comprising:

one of a heating device and a cooling device; and derived timber product sheets serving as outside wall sheets (10), inside wall sheets (1), and at least one of and ceiling sheets (20) and roof sheets (20), each of the derived timber product sheets having at least one inside panel (2, 12, 22) of timber product joined to at least one outside panel (3, 13, 23) of timber product, the inside panel and the outside panel spaced apart from one another, at a distance, by spacers (4, 14, 24), each of the derived timber product sheets being continuously in one piece at least in one direction, and being in dimensions required for a particular use and with edge executions necessary for the particular use, each of the derived timber product sheets having cavities (5, 15, 25) between the inside panel and the outside panel (2, 3; 12, 13; 22, 23), wherein, the cavities (5, 15, 25) of the inside wall sheets (10) comprise connections to the one of the heating device and the cooling device, the connections connecting the cavities of inside wall sheets (10) to the one of the heating device and cooling device, in an area of a horizontal joint of the inside wall sheets (1) and the outside wall sheets (10) the spacers (4, 14) project on a lower edge of the inside wall sheets (1) and the outside wall sheets (10), and the spacers (4) are standing back on an upper edge of the inside wall sheets (1) and the outside wall sheets (10) by at least a projecting length of the spacers projecting on the lower edge of the inside wall sheets and the outside wall sheets.

* * * * *